US011897673B2

(12) United States Patent
Bressan et al.

(10) Patent No.: US 11,897,673 B2
(45) Date of Patent: Feb. 13, 2024

(54) CHILD-PROOF PACKAGE AND PROCESS OF MAKING THE SAME, METHOD FOR CLOSING AND OPENING SAID PACKAGE

(71) Applicant: I.G.B. S.R.L., Milan (IT)

(72) Inventors: Alessio Bressan, Varese (IT); Michel Bressan, Induno Olona (IT); Alberto Gandolla, Induno Olona (IT)

(73) Assignee: I.G.B. S.R.L., Milan (IT)

( * ) Notice: Subject to any disclaimer, the term of this patent is extended or adjusted under 35 U.S.C. 154(b) by 52 days.

(21) Appl. No.: 17/639,488

(22) PCT Filed: Aug. 28, 2020

(86) PCT No.: PCT/IB2020/058043
§ 371 (c)(1),
(2) Date: Mar. 1, 2022

(87) PCT Pub. No.: WO2021/044268
PCT Pub. Date: Mar. 11, 2021

(65) Prior Publication Data

US 2022/0306336 A1 Sep. 29, 2022

(30) Foreign Application Priority Data

Sep. 2, 2019 (IT) ..... 102019000015399

(51) Int. Cl.
*B65D 5/68* (2006.01)

(52) U.S. Cl.
CPC ..... *B65D 5/685* (2013.01); *B65D 2215/00* (2013.01); *B65D 2215/02* (2013.01)

(58) Field of Classification Search
CPC ..... B65D 5/685
See application file for complete search history.

(56) References Cited

U.S. PATENT DOCUMENTS 1,130,271 A 3/1915 Hammond
1,253,489 A 1/1918 Houghland
(Continued)

FOREIGN PATENT DOCUMENTS

CH 710519 A2 * 6/2016 ..... B65D 5/48
CN 204642380 9/2015
(Continued)

OTHER PUBLICATIONS

International Search Report and Written Opinion of the ISA for PCT/ IB2020/058043, dated Nov. 12, 2020, 20 pages.
(Continued)

*Primary Examiner* — Mollie Impink
(74) *Attorney, Agent, or Firm* — Nixon & Vanderhye P.C.

(57) ABSTRACT

A package (100) including a container (1) and a case (102) configured for receiving the container; the case is movable between a closed condition and an open condition in which respectively it prevents and allows the access to the container. The package also comprises a safety device (11) having: a first coupling portion (12) internally carried by the case, a second coupling portion (13) externally carried by the container. At least one between the first and second coupling portion (12, 13) is movable with respect to the other between a first operative position in which they can be engaged with each other and a second operative position in which cannot be engaged with each other.

19 Claims, 10 Drawing Sheets

(56) References Cited

U.S. PATENT DOCUMENTS

| | | | | |
|---|---|---|---|---|
| 2,579,346 | A | 12/1951 | Theander | |
| 2,652,969 | A | 9/1953 | Pfaff | |
| 2,711,282 | A | 6/1955 | D'Esposito | |
| 2,777,630 | A | 1/1957 | Moberger | |
| 3,116,007 | A | 12/1963 | D'Esposito et al. | |
| 3,692,231 | A * | 9/1972 | Neitzke | B65D 5/685 206/815 |
| 3,860,111 | A | 1/1975 | Thompson | |
| 4,053,100 | A | 10/1977 | Baptist | |
| 6,296,175 | B1 | 10/2001 | Dixon | |
| 6,394,275 | B1 | 5/2002 | Paliotta et al. | |
| 6,491,211 | B1 | 12/2002 | Evans et al. | |
| 2005/0173291 | A1 | 8/2005 | Specker et al. | |
| 2008/0283434 | A1 * | 11/2008 | Gelardi | B65D 83/0463 206/459.1 |
| 2012/0234701 | A1 | 9/2012 | Albrecht et al. | |
| 2014/0262839 | A1 | 9/2014 | Le et al. | |
| 2014/0346220 | A1 | 11/2014 | Saulas | |
| 2017/0297803 | A1 * | 10/2017 | Chambers | B65D 5/38 |
| 2020/0039707 | A1 | 2/2020 | Kachian et al. | |

FOREIGN PATENT DOCUMENTS

| | | |
|---|---|---|
| DE | 9214914 | 2/1993 |
| EP | 0 443 930 | 8/1991 |
| EP | 0 454 506 | 10/1991 |
| EP | 0 571 711 | 12/1993 |
| EP | 1 743 842 | 1/2007 |
| EP | 2 808 265 | 12/2014 |
| EP | 3 090 955 | 11/2016 |
| EP | 3 216 712 | 9/2017 |
| FR | 2 609 689 | 7/1988 |
| FR | 2 646 830 | 11/1990 |
| WO | 2004/052749 | 6/2004 |
| WO | 2005/068304 | 7/2005 |
| WO | 2009/038219 | 3/2009 |
| WO | 2012/112538 | 8/2012 |
| WO | 2013014462 | 1/2013 |
| WO | 2015/170203 | 11/2015 |
| WO | 2016/198978 | 12/2016 |
| WO | 2017/216662 | 12/2017 |

OTHER PUBLICATIONS

U.S. Appl. No. 17/639,782, Office Action, dated May 18, 2023, 26 pages.

U.S. Appl. No. 17/639,891, Office Action, dated May 25, 2023, 26 pages.

U.S. Appl. No. 17/639,891, Response, Aug. 25, 2023, 23 pages.

* cited by examiner

CHILD-PROOF PACKAGE AND PROCESS OF MAKING THE SAME, METHOD FOR CLOSING AND OPENING SAID PACKAGE

This application is the U.S. national phase of International Application PCT/IB2020/058043, filed Aug. 28, 2020, which designated the U.S. and claims priority to Italian patent application IT 102019000015399, filed Sep. 2, 2019, the entire contents of each of which are hereby incorporated by reference.

FIELD OF THE FINDING

The object of the present invention is a child-proof package and a process for making the same, as well as a method for closing and opening the package. The package can have application in the field of packaging for products of various kind, such as: drugs, cosmetics, cleaning products (detergents for linens/sheets and dishes), foods and tobacco-based products (cigars and cigarettes).

STATE OF THE ART

As is known, child-proof packages are available on the market that are designed in order to be difficult for children under 5 years old to open; these packages are employed for preventing children from coming into contact with products that are potentially dangerous for them.

One known child-proof package comprises a paper case adapted to receive a plastic material blister at its own interior that is intended to contain a plurality of products. The case has, at opposite lateral walls, two slits intended to receive in engagement two projections of the blister: in the condition in which the blister is housed in the case, the engagement of the projections with the slits prevents the extraction of the blister by means of only a pulling action of the same. For the extraction of the blister, it is necessary to press on the projections so as to cause the disengagement thereof from the slits: only at this point it is possible to extract the blister from the case. The Applicant has detected that such packages, due to the closure type are poorly flexible in their use: in order to be able to define a child-proof safety system, the case can only receive a blister specially designed for that particular case. The blisters must therefore be made by means of specific production methods, preventing the manufacturing thereof by means of standard production machines. It is also indicated that the blisters of the described packages have a rather complex structure due to the presence of the protuberances, which negatively affects the production and product costs.

A further known child-proof package is described in the patent application No. WO 2017/216662 A1. The package comprises a case adapted to receive a casing for housing products at its own interior. The case, in the form of a hollow casing, internally has an engagement portion which is configured for engaging with an abutment element carried by the container in order to allow the locking of the container itself within the case and consequently preventing the picking up of products. The disengagement between the case and the container occurs following the insertion of an opening device within the package.

A further known package is described in the U.S. Pat. No. 4,053,100 A. Such package comprises a container with tray form configured for defining a compartment for containing products and having a single top opening, delimited by a free edge, through which it is possible to deposit/pick up the products. The package also comprises a lid configured for being placed outside the container in closing the top opening. The container comprises two tabs folded outside the compartment starting from the free edge and which are configured for being engaged with two respective undercuts defined within the lid. The cover comprises two through accesses configured for allowing a user, during a closed condition of the package, to disengage the tabs from the undercuts of the lid in order to allow the opening of said package.

A further known package is described in the European patent application No. EP 0 571 711 A2. Such package comprises a container configured for defining a compartment for containing products and having a single top opening, delimited by a free edge, through which it is possible to deposit/pick up the products. The package also comprises a case configured for being placed outside the container in closing the top opening. The container comprises two through pockets defined on the two opposite lateral walls of the container, which are configured for engagingly receiving two respective folded tabs defined on a free edge of the case.

The Applicant has detected that the above-described known solutions have several limitations and therefore they can be improved with regard to several aspects.

Object of the Finding

Object of the present invention is therefore that of substantially resolving at least one of the drawbacks and/or limitations of the preceding solutions.

One objective of the present invention is that of providing a package that is flexible in its use, having a safety system that is highly effective, capable of preventing the opening of the package by children, but which simultaneously can be easily openable by an adult. Another objective of the present invention is that of providing a package having a structure that can be handled with difficulty by children and hence is capable of preventing the correct grip thereof for the opening thereof. Another object of the present invention is that of providing a package having a simple structure, which can be manufactured in a quick and inexpensive manner. Another object of the present invention is to provide a package having a stable structure that is able to ensure its own integrity following multiple openings and closings of the same.

These and other objects, which will be clearer from the following description, are substantially attained by a package, a process for making the package and a method for closing and opening the same in accordance with that expressed in one or more of the enclosed claims and/or of the following aspects.

SUMMARY

In one aspect, a child-proof package (100) is provided comprising:

- at least one container (1) defining a compartment (3) for housing at least one product, said container (1) having a predetermined number of lateral walls (4) defining an opening (5) delimited by a free edge (6), said opening (5) being configured for allowing the insertion and picking up of the product from the container (1),
- at least one case (102) having a predetermined number of lateral walls (104) defining at least one access (105) delimited by a free edge (106) configured for allowing the passage of the container (1), said predetermined number of lateral walls (104) of the case (102) delimiting an internal volume (103) configured for receiving in insertion at least part of the container (1), in which case (102) and container (1) are relatively movable with respect to each other at least between:

a closed condition in which the case (102) obstructs the opening of the container (1), wherein the container (1), in said closed condition, is at least partly arranged in the internal volume (103), an open condition in which the case (102) allows the communication between the compartment (3) and the external environment, at least one safety device (11) comprising:

at least one first coupling portion (12) carried by the case (102), at least one second coupling portion (13) carried by the container (1).

In a further aspect in accordance with the preceding aspect at least one between said first and second coupling portion (12, 13), at least in the closed condition between container and case, is movable relative to the other between said first and second coupling portion (12, 13) at least between:

a first operative position in which the first and the second coupling portion (12, 13) are configured for being stably engaged with each other to define a locking condition of the safety device (11) in which said first and second coupling portion (12, 13) prevent case and container from passing from the closed condition to the open condition, a second operative position in which the first and the second coupling portion (12, 13) cannot be engaged with each other in a manner such that case and container can freely pass from the closed condition to the open condition.

In a further aspect in accordance with any one of the preceding aspects the first and the second coupling portion (12, 13) are configured for being engaged with each other to define a locking condition of the safety device (11) in which said first and second coupling portion (12, 13) prevent case and container from passing from the closed condition to the open condition.

In a further aspect in accordance with any one of the preceding aspects the first coupling portion (12) is arranged at least partly in the internal volume (103). In a further aspect in accordance with any one of the preceding aspects the second coupling portion is arranged outside the compartment (3). In a further aspect in accordance with any one of the preceding aspects the predetermined number of lateral walls (10) of the case (102) defines a top opening delimited by the free edge (106).

In a further aspect in accordance with any one of the preceding aspects the case (102), optionally the lateral wall of the case directly carrying the first coupling portion (12), has at least one through opening (48) configured for allowing, in the closed condition of the case and the container and from outside the package, contacting at least one between said first and second coupling portion in order to allow the movement thereof from the first to the second operative position, and vice versa. In a further aspect in accordance with any one of the preceding aspects the through opening (48) is configured for placing in communication, at least in the closed condition of the container and the case, the internal volume of the case and the external environment the package. In a further aspect in accordance with any one of the preceding aspects the at least one between said first and second coupling portions (12, 13) movable relative to the other between said first and second coupling portion (12, 13) comprises at least one handling portion (91) facing the through opening (48) of the case and configured for allowing the movement of said first and/or second coupling portion from the first to the second operative position, and vice versa. In a further aspect in accordance with any one of the preceding aspects the through opening (48) is configured for allowing a user, at least during the closed condition of the container and the case, to contact the handling portion from outside the package and to move the first and/or second coupling portion between the first and second operative position, and vice versa.

In a further aspect in accordance with any one of the preceding aspects, at least one first coupling portion (12) is integrally joined with at least one lateral wall of the case (102). In a further aspect in accordance with any one of the preceding aspects the container is made of sheet material, optionally paper. In a further aspect in accordance with any one of the preceding aspects the case (102) is made of sheet material, optionally paper.

In a further aspect in accordance with any one of the preceding aspects the first coupling portion (12) is entirely arranged in the internal volume of the case (102). In a further aspect in accordance with any one of the preceding aspects the first coupling portion (12) is distanced from the free edge (106) of the case (102). In a further aspect in accordance with any one of the preceding aspects the second coupling portion (13) is distanced from the free edge (6) of the container (1).

In a further aspect in accordance with any one of the preceding aspects the first and the second coupling portion (12, 13), in the locking condition, are engaged outside the compartment (3) of the container (1). In a further aspect in accordance with any one of the preceding aspects the first and the second coupling portion (12, 13), in the locking condition, are engaged inside the internal volume (103) of the case (102). In a further aspect in accordance with any one of the preceding aspects the container (1), in the open condition, is distinct and completely separate from the case (102).

In a further aspect in accordance with any one of the preceding aspects the through opening (48) is distinct and separate from the free edge of the case (102). In a further aspect in accordance with any one of the preceding aspects the through opening is defined in interposition between a top wall (109) and the free edge of the case.

In a further aspect in accordance with any one of the preceding aspects the first coupling portion (12) comprises at least one tab (12*a*) emerging in the internal volume (103) according to a direction entering the latter. In a further aspect in accordance with any one of the preceding aspects the tab (12*a*) is engaged with at least one lateral wall (104) of the case (102). In a further aspect in accordance with any one of the preceding aspects the tab (12*a*) defines an undercut delimited by at least one gripping edge (12*b*) placed entirely in the internal volume (103). In a further aspect in accordance with any one of the preceding aspects the gripping edge (12*b*) of the tab is distinct and distanced from the free edge (106) of the access (105).

In a further aspect in accordance with any one of the preceding aspects the gripping edge (12*b*) of the tab (12*a*) of the first coupling portion (12) is at least for one section tilted with respect to the free edge (106) of the access (105). In a further aspect in accordance with any one of the preceding aspects the gripping edge (12*b*) of the tab (12*a*) is, at least for one section, tilted with respect to the free edge (106) of the access (105) by an angle comprised between 20° and 80°, still more optionally by an angle comprised between 30° and 70°.

In a further aspect in accordance with any one of the preceding aspects the gripping edge (12*b*) of the tab (12*a*) of the first coupling portion (12) has a substantially "V" or "C" shape whose concavity is directed on the opposite side with respect to the free edge (106) of the access (105) of the case.

In a further aspect in accordance with any one of the preceding aspects at least one first coupling portion (12) is integrally joined with at least one lateral wall (104) of the case (102) by means of a folding edge to define a folded portion. In a further aspect in accordance with any one of the preceding aspects the folding edge between the first coupling portion (12) and the lateral wall (104) of the case directly carrying said first coupling portion (12) defines at least one part of the free edge (106) of the access (105) of the case (102).

In a further aspect in accordance with any one of the preceding aspects the predetermined number of lateral walls (104) of the case (102) comprises:

a front wall (104*a*), a rear wall (104*b*) opposite the front wall (104*b*), a first lateral wall (104*c*) which connects the front and rear walls (104*a*, 104*b*), a second lateral wall (104*d*) opposite the first lateral wall and which also connects the front and rear walls (104*a*, 104*b*).

In a further aspect in accordance with any one of the preceding aspects the first coupling portion (12) is engaged at least at the front wall (104*a*) of the case (102). In a further aspect in accordance with any one of the preceding aspects the package comprises a first coupling portion (12) carried by the front wall (104*a*) of the case (102) and a first coupling portion (12) carried by the rear wall (104*b*) of the case (102).

In a further aspect in accordance with any one of the preceding aspects the case (102) comprises a top wall opposite the access (105) and which is configured for being abutted, in the closed condition of the container and the case, against the free edge (6) of the opening (5) in order to obstruct the latter. In a further aspect in accordance with any one of the preceding aspects the predetermined number of lateral walls (104) of the case (102) emerges from a perimeter edge from the top wall (109). In a further aspect in accordance with any one of the preceding aspects the gripping edge (12*b*) of the first coupling portion (12) is arranged in interposition between the top wall (109) and the access (105) of the case (102).

In a further aspect in accordance with any one of the preceding aspects the second coupling portion (13) comprises at least one panel (13*a*) engaged with at least one lateral wall (4) of the container (1) and emerging from said lateral wall (4) according to a direction exiting from the compartment (3). In a further aspect in accordance with any one of the preceding aspects the panel (13*a*) of the second coupling portion (13) defines an undercut delimited by at least one gripping edge (13*b*) placed outside the compartment (3). In a further aspect in accordance with any one of the preceding aspects the gripping edge (13*b*) of the panel (13*a*) of the second coupling portion (13) is distinct and distanced from the free edge (6) of the opening (5) of the container itself. In a further aspect in accordance with any one of the preceding aspects the undercut defined by the panel (13*a*) of the second coupling portion (13), in the closed condition and in the first operative position of the first and second coupling portion, is stably engaged with the undercut of the tab (12*a*) of the first coupling portion (12) to define said locking condition.

In a further aspect in accordance with any one of the preceding aspects the panel (13*a*) of the second coupling portion (13) has a substantially triangular shape or substantially trapezoidal shape or "V" or "C" shape. In a further aspect in accordance with any one of the preceding aspects at least one section of the gripping edge (13*b*) of the panel (13*a*) has a substantially triangular shape or substantially trapezoidal shape or "V" or "C" shape.

In a further aspect in accordance with any one of the preceding aspects at least one section of the gripping edge (13*b*) of the panel (13*a*) of said second coupling portion (13) is tilted with respect to the free edge (6) of the opening (5). In a further aspect in accordance with any one of the preceding aspects, at least one section of the gripping edge (13*b*) of the panel (13*a*) is tilted with respect to the free edge (6) of the container (1) by an angle comprised between 20° and 80°, still more optionally by an angle comprised between 30° and 70°.

In a further aspect in accordance with any one of the preceding aspects, the panel (13*a*) of the second coupling portion (13) is extended substantially along a plane which is tilted with respect to a lying plane of the lateral wall (4) of the container (1) directly carrying said panel, optionally by an angle comprised between 1° and 30°, still more optionally by an angle comprised between 1° and 20°. In a further aspect in accordance with any one of the preceding aspects, the tilt angle of the panel (13*a*) is measured between facing surfaces of the panel (13*a*) and of the lateral wall of the container directly carrying (optionally integrally joined to) said panel (13*a*).

In a further aspect in accordance with any one of the preceding aspects the panel (13*a*) of the second coupling portion (13) substantially emerges from a lying plane of the lateral wall (4) of the container directly carrying said panel (13*a*), according to a direction exiting from the compartment (3).

In a further aspect in accordance with any one of the preceding aspects the panel (13*a*) of the second coupling portion is joined, by means of a folding edge, to a lateral wall (4) of the container (1) to define a folded portion, the panel (13*a*) facing and at least partly superimposed on the lateral wall (4) with which it is directly integrally joined. In a further aspect in accordance with any one of the preceding aspects the panel (13*a*) is integrally joined with the lateral wall of the container (4) essentially defining, in cooperation with the latter, a single external lateral wall of the container. In a further aspect in accordance with any one of the preceding aspects the panel (13*a*) is made on a lateral wall (4) of the container by means of a through cut of said lateral wall, optionally the panel (13*a*) defining at least part of the lateral wall (4) of the container with which the same panel is integrally joined. In a further aspect in accordance with any one of the preceding aspects the panel (13*a*) projects from the lateral wall (4) with which it is integrally joined according to a direction exiting from the compartment (3).

In a further aspect in accordance with any one of the preceding aspects the panel (13*a*) projects from the lateral wall (4) with which it is integrally joined according to a direction exiting from the compartment (3).

In a further aspect in accordance with any one of the preceding aspects the safety device (11) comprises a second coupling portion (13) for each first coupling portion (12) present on the case (102). In a further aspect in accordance with any one of the preceding aspects the predetermined number of lateral walls (4) of the container (1) comprises:

a front wall (4*a*), a rear wall (4*b*) opposite said front wall (4*a*) of the container, a first lateral wall (4*c*) which connects the front and rear wall (4*a*, 4*b*) of the container, a second lateral wall (4*d*) opposite the first lateral wall of the container and which also connects the front and rear wall (4*a*, 4*b*) of the container.

In a further aspect in accordance with any one of the preceding aspects wherein, in the closed condition:

the front walls (4*a*, 104*a*) respectively of the container and of the case directly face each other, the rear walls (4*b*, 104*b*) respectively of the container and of the case directly face each other, the first lateral walls (4*c*, 104*c*) respectively of the container and of the case directly face each other, the second lateral walls (4*b*, 104*d*) respectively of the container and of the case directly face each other.

In a further aspect in accordance with any one of the preceding aspects the predetermined number of lateral walls of the case (104) is at least partly counter-shaped with respect to the predetermined number of lateral walls (4) of the container. In a further aspect in accordance with any one of the preceding aspects the second coupling portion (13) is engaged at least with the front wall (4*a*) of the container (1). In a further aspect in accordance with any one of the preceding aspects the package comprises a second coupling portion (13) carried by the front wall (4*a*) of the container (1) and a second coupling portion (13) carried by the rear wall (4*b*) of the container (1).

In a further aspect in accordance with any one of the preceding aspects the container (1) comprises a bottom wall (9), the predetermined number of lateral walls (4) of the container (1) emerging from a perimeter edge from the bottom wall (9). In a further aspect in accordance with any one of the preceding aspects the bottom wall (9), in the closed condition, is opposite the top wall (109) of the case (102). In a further aspect in accordance with any one of the preceding aspects the at least one second coupling portion (13) of the container (1) is defined in interposition between the bottom wall (9) and the opening (5) of the container (1).

In a further aspect in accordance with any one of the preceding aspects the at least one second coupling portion (13) of the container (1) is defined in interposition between the bottom wall (9) and the free edge (6) of the container (1). In a further aspect in accordance with any one of the preceding aspects the at least one second coupling portion (13), optionally the panel (13*a*), is distinct and distanced from the free edge (6) of the opening (5) of the container (1). In a further aspect in accordance with any one of the preceding aspects the at least one second coupling portion (13), optionally the panel (13*a*), is placed at a minimum distance of the free edge (6) of the container (1) equal to or greater than 5 mm, optionally equal to or greater than 7 mm, still more optionally comprised between 7 mm and 30 mm. In a further aspect in accordance with any one of the preceding aspects the panel (13*a*) of the second coupling portion (13) is extended starting from an attachment portion (13*c*) along a longitudinal direction away from the free edge (6) of the container (1). In a further aspect in accordance with any one of the preceding aspects the attachment portion (13*c*) of the panel (13*a*) is integrally joined with the lateral wall (4) of the container (1) directly carrying said panel (13*a*). In a further aspect in accordance with any one of the preceding aspects the attachment portion (13*c*) of the panel (13*a*) is distanced from the free edge (6) of the container (1).

In a further aspect in accordance with any one of the preceding aspects the panel (13*a*) of the second coupling portion (13) is extended in length starting from a lateral wall (4) of the container (1) directly carrying said panel (optionally starting from the attachment portion 13*c*) along a predetermined longitudinal direction, wherein said panel (13*a*) has a predetermined length equal to or greater than 15 mm, optionally comprised between 15 mm and 100 mm; wherein the predetermined length of the panel is measured along said predetermined longitudinal direction.

In a further aspect in accordance with any one of the preceding aspects the panel (13*a*) of the second coupling portion (13) is extended in length starting from a lateral wall (4) of the container (1) along a predetermined longitudinal direction, wherein the ratio between the distance present between the panel (13*a*) and the free edge (6) of the container (1) and the length of said panel (13*a*) is equal to or lower than 2, optionally comprised between 0.05 and 1, still more optionally comprised between 0.2 and 1; wherein the predetermined length of the panel is measured along said predetermined longitudinal direction.

In a further aspect in accordance with any one of the preceding aspects the tab (12*a*) faces the lateral wall (104) of the case directly carrying said tab.

In a further aspect in accordance with any one of the preceding aspects the tab (12*a*) is tilted with respect to the lateral wall of the case directly carrying said tab by an angle lower than 40°, optionally comprised between 1° and 30°; optionally said angle being measured between facing surfaces of the tab (12*a*) and of the lateral wall of the case directly carrying said tab (12*a*). In a further aspect in accordance with any one of the preceding aspects the tab (12*a*) is extended substantially parallel to the lateral wall of the case (102) directly carrying said tab (12*a*). In a further aspect in accordance with any one of the preceding aspects the tab (12*a*) of the first coupling portion (12) is extended along a plane. In a further aspect in accordance with any one of the preceding aspects the tab (12*a*) is extended substantially parallel with respect to the lateral wall, with respect to which it is joined by means of the folding edge.

In a further aspect in accordance with any one of the preceding aspects the panel (13*a*) of the second coupling portion (13) faces the lateral wall (4) of the container directly carrying said panel (13*a*). In a further aspect in accordance with any one of the preceding aspects the panel (13*a*) of the second coupling portion (13) is extended along a plane.

In a further aspect in accordance with any one of the preceding aspects the first coupling portion (12) is movable with respect to the case (102). In a further aspect in accordance with any one of the preceding aspects the first coupling portion (12) is movable with respect to the case (102) between the first and the second operative position. In a further aspect in accordance with any one of the preceding aspects the tab (12*a*), in the first operative position, is configured for being engaged with the panel (13*a*) of the second coupling portion (13). In a further aspect in accordance with any one of the preceding aspects the first coupling portion (12) is movable along a trajectory which lies on a plane substantially parallel to a lying plane of the lateral wall (104) of the case (102) directly carrying said first coupling portion (12). In a further aspect in accordance with any one of the preceding aspects the second coupling portion (13) is movable close to and away from the compartment (3) of the container along a predetermined trajectory, wherein the first coupling portion (12), in the closed condition of the package, is movable at least along a direction transverse with respect to the trajectory along which said second coupling portion (13) is movable. In a further aspect in accordance with any one of the preceding aspects the first coupling portion (optionally the tab 12*a*), at least in the closed condition of the package, is movable along a plane relative to the case (102). In a further aspect in accordance with any one of the preceding aspects the first coupling portion (optionally the tab 12*a*), at least in the locking condition, is movable along a plane relative to the case (102), optionally in order to be disengaged from the second coupling portion (13).

In a further aspect in accordance with any one of the preceding aspects the first coupling portion (12), during the movement from the first to the second operative position, is configured for moving the second coupling portion (optionally the panel 13*a* of the second coupling portion) close to the compartment (3) of the container, optionally in order to allow the disengagement between the first and the second coupling portion (12, 13).

In a further aspect in accordance with any one of the preceding aspects the package comprises a selector (90) carried by the case (102) on which at least one first coupling portion (12) is defined. In a further aspect in accordance with any one of the preceding aspects the selector (90), at least in the closed condition of the package, is movable relative to the case, optionally relative to the case and to the container. In a further aspect in accordance with any one of the preceding aspects the selector is made of sheet material, optionally flat. In a further aspect in accordance with any one of the preceding aspects the selector (90) is stably carried only by at least one lateral wall of the case (102). In a further aspect in accordance with any one of the preceding aspects the selector (90) is movable between a first and a second operative position coinciding with the first and second operative positions of the first coupling portion (12).

In a further aspect in accordance with any one of the preceding aspects the case comprises at least one external panel (10*a*) and an internal panel (10*b*) defining a seat (49) within which the first coupling portion (12) is housed. In a further aspect in accordance with any one of the preceding aspects the external panel (10*a*) defines at least part of a lateral wall of the case (102), optionally at least part of the front wall (104*a*) of the case. In a further aspect in accordance with any one of the preceding aspects the internal panel (10*b*) is arranged in the internal volume of the case. In a further aspect in accordance with any one of the preceding aspects the internal panel (10*b*), at least in the closed condition, is arranged in interposition between the external panel (10*a*) and the container (1). In a further aspect in accordance with any one of the preceding aspects the external panel (10*a*) and the internal panel (10*b*) are integrally joined at a folding edge (10*c*) to define a folded portion. In a further aspect in accordance with any one of the preceding aspects, the external and internal panels (10*a*, 10*b*) of the case face each other. In a further aspect in accordance with any one of the preceding aspects the external panel (10*a*) and the internal panel (10*b*) are extended along a plane substantially parallel to each other.

In a further aspect in accordance with any one of the preceding aspects the predetermined number of lateral walls (104) of the case (102) defines a top opening delimited by the free edge (106). In a further aspect in accordance with any one of the preceding aspects the folding edge (10*c*) of the external panel (10*a*) and internal panel (10*b*) defines at least part of said free edge (106) of the case (102). In a further aspect in accordance with any one of the preceding aspects the first coupling portion (12), optionally the tab (12*a*), is engaged in the seat (49), the external panel (10*a*) and the internal panel (10*b*) at least partly interposed. In a further aspect in accordance with any one of the preceding aspects the first coupling portion (12), optionally the tab (12*a*) of the first coupling portion, is movable within the seat (49).

In a further aspect in accordance with any one of the preceding aspects the first coupling portion (12), optionally the tab, is slidably movable with respect to the external and internal panels. In a further aspect in accordance with any one of the preceding aspects the first coupling portion (12) is movable, between the first and the second operative position, and vice versa, along a direction substantially parallel to a lying plane of the lateral wall of the case directly carrying said first coupling portion (12). In a further aspect in accordance with any one of the preceding aspects the first coupling portion (12) is movable, between the first and the second operative position, and vice versa, along a direction substantially parallel to a lying plane of the external panel (10*a*) and/or of the internal panel (10*b*). In a further aspect in accordance with any one of the preceding aspects the external panel (10*a*), defining at least part of a lateral wall of the case (102), lies on a plane. In a further aspect in accordance with any one of the preceding aspects, at least one part of the first coupling portion (12) lies substantially on a plane parallel to the lying plane of the external panel (10*a*).

In a further aspect in accordance with any one of the preceding aspects the first coupling portion (12), optionally the tab (12*a*), is movable relative to the case, optionally between the first and the second operative position and vice versa, parallel to the folding edge (10*c*) of the external and internal panels (10*a*, 10*b*).

In a further aspect in accordance with any one of the preceding aspects the selector (90) is housed and slidably movable within the seat (49). In a further aspect in accordance with any one of the preceding aspects the selector (90) is extended substantially parallel to at least one between the external and internal panel (10*a*, 10*b*). In a further aspect in accordance with any one of the preceding aspects the selector is movable along a plane substantially parallel to a lying plane of at least one between the internal panel (10*b*) and the external panel (10*a*) of the case defining the seat (49) within which is housed the selector. In a further aspect in accordance with any one of the preceding aspects the selector (90), at least in the closed condition of the package, is configured for moving the second coupling portion (13) close to the compartment (3) of the container.

In a further aspect in accordance with any one of the preceding aspects the second coupling portion (13), optionally the panel (13*a*), is movable relative to the container between the first and the second operative position, and vice versa, parallel to a lying plane of the lateral wall of the container directly carrying said second coupling portion. In a further aspect in accordance with any one of the preceding aspects the second coupling portion (13), optionally the panel (13*a*), is movable relative to the container between the first and the second operative position, and vice versa, parallel to a section of the free edge (6) of the container defined by the lateral wall directly facing the movable second coupling portion.

In a further aspect in accordance with any one of the preceding aspects, the movable first coupling portion (12), optionally the tab (12*a*), is carried by the front wall (104*a*) of the case, wherein said first coupling portion (12), optionally the tab (12*a*), during the movement between the first and the second operative position, and vice versa, is movable close to and away from the first and/or second lateral wall (104*c*, 104*d*) of the case.

In a further aspect in accordance with any one of the preceding aspects the second coupling portion (13), optionally the panel (13*a*), mobile is carried by the front wall (4*a*) of the container, wherein said second coupling portion (13), optionally said panel (13*a*), during the movement between the first and the second operative position, and vice versa, is movable close to and away from the first and/or second lateral wall (4*c*, 4*d*) of the container.

In a further aspect in accordance with any one of the preceding aspects the first coupling portion (12) is movable via sliding within the internal volume of the case.

In a further aspect in accordance with any one of the preceding aspects the internal panel (10*b*) has a through pocket configured for allowing the tab (12*a*) to engage the second coupling portion (13). In a further aspect in accordance with any one of the preceding aspects the pocket of the internal panel (10*b*), in the closed condition and in the first operative position of the first and second coupling portion (12, 13), is configured for allowing the panel (13*a*) of the second coupling portion (13) to stably engage the tab (12*a*) of the first coupling portion. In a further aspect in accordance with any one of the preceding aspects the pocket of the internal panel (10*b*) is configured for allowing, in the closed condition and in the first operative position of the first and second coupling portion (12, 13), the passage of the panel (13*a*) of the second coupling portion in order to allow the engagement of the latter with the first coupling portion. In a further aspect in accordance with any one of the preceding aspects the pocket of the internal panel (10*b*), in the closed condition of the package faces the second coupling portion (13). In a further aspect in accordance with any one of the preceding aspects the first coupling portion (12) is movable with respect to the internal panel (10*b*) between:

- a first operative position in which at least the gripping edge (12*b*) of the first coupling portion (12) faces the pocket of the internal panel (10*b*),
- a second operative position in which at least the gripping edge (12*b*) of the first coupling portion (12) is offset with respect to the pocket of the internal panel (10*b*).

In a further aspect in accordance with any one of the preceding aspects the first coupling portion (12), in the first operative position, faces the pocket and engaged with the second coupling portion (13) crossing said pocket.

In a further aspect in accordance with any one of the preceding aspects the through opening (48) is configured for allowing, in the closed condition of the case and the container and from outside the package, contacting the first coupling portion (12) in order to allow the movement thereof relative to the case, optionally between the first and the second operative position, and vice versa.

In a further aspect in accordance with any one of the preceding aspects the movement direction of the first coupling portion (12), optionally of the tab (12*a*), is substantially parallel to the folding edge (10*c*) of the external and internal panels (10*a*, 10*b*).

In a further aspect in accordance with any one of the preceding aspects, the at least one through opening (48) is defined on the external panel (10*a*) and is configured for allowing, in the closed condition of the case and the container and from outside the package, intervention on the selector (90) in order to allow the movement thereof within the seat (49). In a further aspect in accordance with any one of the preceding aspects the through opening (48) is configured for placing in communication, at least in the closed condition of the container and the case, the seat (49) and the external environment with the package. In a further aspect in accordance with any one of the preceding aspects the selector (90) comprises a handling portion (91) facing the through opening (48) of the case and configured for allowing a user, at least during the closed condition of the container and the case, the movement of the selector within the seat, optionally in order to allow the movement of the first coupling portion (12) between the first and the second operative position, and vice versa.

In a further aspect in accordance with any one of the preceding aspects the selector, in the second operative position, is configured for acting thrustingly against the second coupling portion (13) carried by the container (1). In a further aspect in accordance with any one of the preceding aspects the selector, during the movement between the first and the second operative position, is configured for pushing the second coupling portion (13) close to the compartment (3) of the container. In a further aspect in accordance with any one of the preceding aspects the selector, during the movement between the first and the second operative position and during the closed condition of the package, is configured for relatively moving away said first and second coupling portion (12, 13). In a further aspect in accordance with any one of the preceding aspects the selector, during the movement between the first and the second operative position and during the closed condition of the package, is configured for directly moving the second coupling portion (13) away from the first coupling portion (12) carried by the same selector.

In a further aspect in accordance with any one of the preceding aspects the safety device (11) comprises a release portion (17) configured for allowing, at least in the locking condition of the safety device (11), intervention from outside the package on at least one between said first and second coupling portions (12, 13) in order to allow the disengagement thereof and hence allow the passage of case (102) and container (1) from the closed condition to the open condition. In a further aspect in accordance with any one of the preceding aspects the release portion (17) is configured for defining at least one through access (18) on the case (102). In a further aspect in accordance with any one of the preceding aspects the release portion (17), in the locking condition, is arranged at a first and a respective second coupling portion (12, 13). In a further aspect in accordance with any one of the preceding aspects the release portion (17) is configured for allowing a user, at least in the locking condition of the safety device (11), intervention from outside the package on at least one of said first and second coupling portion (12, 13) manually and/or by means of an opening device insertable through the through access (18).

In a further aspect in accordance with any one of the preceding aspects the release portion (17), optionally the through access (18), is configured for allowing, at least in the locking condition of the safety device (11), intervention from outside the package (100) directly on the second coupling portion (13).

In a further aspect in accordance with any one of the preceding aspects the through access (18) of the release portion (17) has an open perimeter profile. In a further aspect in accordance with any one of the preceding aspects the through access (18) of the release portion (17) is integrally joined with the free edge (106) of the access (105) of the case (102) and essentially defines a groove of said free edge (106). In a further aspect in accordance with any one of the preceding aspects the through access (18) of the release portion (17) has a closed perimeter profile. In a further aspect in accordance with any one of the preceding aspects the through access (18) of the release portion (17) is distanced from the free edge (106) of the access (105) of the case (102). In a further aspect in accordance with any one of the preceding aspects the through access (18) of the release portion (17) is interposed between said free edge (106) of the access (105) and the top wall of the same case (102).

In a further aspect in accordance with any one of the preceding aspects the second coupling portion (13), optionally the panel (13*a*) of the second coupling portion (13), is interposed—in the locking condition—between the release portion (17) and the first coupling portion (12). In a further aspect in accordance with any one of the preceding aspects the through access (18) of the release portion is configured for allowing a user, during the locking condition, to thrustingly act directly on the panel (13*a*) of the second coupling portion (13) in order to allow the disengagement with the tab (12*a*) of the first coupling portion (12).

In a further aspect in accordance with any one of the preceding aspects the package (100) comprises:

- two first coupling portions (12), one for each of said front and rear wall (104*a*, 104*b*) of the case,
- two second coupling portions (13), one for each of said front and rear wall (4*a*, 4*b*) of the container, each of said second coupling portions (13) being configured for cooperating with a respective first coupling portion (12) of the case (102),
- at least one selector (90) carried by the case (102) and placed at the front wall (104*a*) of the latter,
- a release portion (17) defined on the rear wall (104*b*) of the case.

In a further aspect, a process of making a package (100) is provided in accordance with any one of the preceding aspects. In a further aspect in accordance with the preceding aspect the process comprises the following steps:

- arranging a first flat blank (50) made of sheet material, optionally made of paper sheet material, said first blank (50) comprising:
  - a central sheet (51),
  - a predetermined number of lateral sheets (52) integrally joined with the central sheet (51) and emerging from the latter starting from a perimeter edge,
- folding the predetermined number of lateral sheets (52) in order to define the predetermined number of lateral walls (104) of the case (102),
- defining the first coupling portion (12) of the safety device (11) at at least one lateral wall of the case,
- arranging a second flat blank (70) made of sheet material, optionally made of paper sheet material, said second blank (70) comprising:
  - a central sheet (71),
  - a predetermined number of lateral sheets (72) integrally joined with the central sheet (71) and emerging from the latter starting from a perimeter edge,
- folding the predetermined number of lateral sheets (72) in order to define the predetermined number of lateral walls (4) of the container (1),
- defining, at at least one of said lateral walls (4) of the container, at least the second coupling portion (13) of the safety device (11).

In a further aspect in accordance with any one of the preceding aspects the second blank is distinct from the first blank.

In a further aspect in accordance with any one of the preceding aspects the central sheet (51) of the first blank (50) has a rectangular shape. In a further aspect in accordance with any one of the preceding aspects each lateral sheet has a rectangular shape. In a further aspect in accordance with any one of the preceding aspects the folding of the lateral sheets (52) of the first blank (50) defines the front wall (104*a*), the rear wall (104*b*), the first and the second lateral part (104*c*, 104*d*) of the case (102). In a further aspect in accordance with any one of the preceding aspects the central sheet (51), following the folding of the lateral sheets (52), of the first blank (50), defines the top wall (109).

In a further aspect in accordance with any one of the preceding aspects the first blank (50) comprises at least one peripheral sheet (53) integrally joined with at least one lateral sheet (52) of the first blank (50), the peripheral sheet (53) of the first blank (50) emerging from a perimeter edge of at least one lateral sheet (52) of the first blank (50) itself on the side opposite the central sheet (51) of the first blank, wherein the step of defining the first coupling portion (12) comprises:

- the folding of the peripheral sheet (53) of the first blank (50) above the lateral sheet (52) of the same first blank (50) with which said peripheral sheet (53) is integrally joined in a manner such that the peripheral sheet defines the internal panel (10*b*) and the lateral sheet (52) defines the external panel (10*a*) with which said internal panel is directly integrally joined,
- arranging a further sheet (78) between said peripheral sheet (53) and lateral sheet (52) folded with respect to each other, with which said peripheral sheet is integrally joined, said further sheet (78) defining the movable first coupling portion (12) relative to the case.

In a further aspect in accordance with any one of the preceding aspects the further sheet (78) is distinct from the peripheral sheet and from the lateral sheet and is movable with respect to the latter.

In a further aspect in accordance with any one of the preceding aspects the first blank (50) comprises at least two peripheral sheets (53) respectively engaged with opposite lateral sheets (52) of the first blank (50) itself with respect to the central sheet (51). In a further aspect in accordance with any one of the preceding aspects the process comprises the following steps:

- folding and constraining each peripheral sheet (53) above the lateral sheet with which said peripheral sheet is directly connected, optionally integrally joined,
- subsequently folding the lateral sheets to define the lateral walls (104) of the case (102) in a manner such that each peripheral sheet (53) defines a respective first coupling portion (12) placed in the internal volume of the case.

In a further aspect in accordance with any one of the preceding aspects the first blank (50) comprises at least one connection sheet (55) which integrally joins two adjacent lateral sheets (52). In a further aspect in accordance with any one of the preceding aspects wherein, following the folding of the lateral sheets (52) of the first blank (50), two adjacent lateral sheets are stably constrained, for example by means of gluing, such that the case can stably maintain a three-dimensional configuration. In a further aspect in accordance with any one of the preceding aspects wherein the process also comprises, simultaneously with the folding of the lateral sheets, the superimposition and joining, for example by means of gluing, of the connection sheet (55) to adjacent folded lateral sheets.

In a further aspect in accordance with any one of the preceding aspects the first blank (50) comprises a first and a second auxiliary sheet (79*a*, 79*b*) integrally joined with each other and emerging from a lateral sheet (52) on the side opposite the central sheet (51) of the first blank, wherein the first auxiliary sheet (79*a*) is interposed between the second auxiliary sheet (79*b*) and the lateral sheet (52) of the first blank, wherein said further sheet (78) is defined on at least one between said first and a second auxiliary sheet (79*a*, 79*b*), optionally by means of a through cut step. In a further aspect in accordance with any one of the preceding aspects, a first and a second further sheet (78*a*, 78*b*) are respectively defined on each of said first and second auxiliary sheets, for example by means of a through cut action, such further sheets configured for defining the first coupling portion (12).

In a further aspect in accordance with any one of the preceding aspects the selector (90) is obtained by means of a step of notching the first and/or second auxiliary sheet (79*a*, 79*b*). In a further aspect in accordance with any one of the preceding aspects wherein, following the notching of the first and/or second auxiliary sheet, said second sheet (79*b*) is folded on the first auxiliary sheet (79*a*), the first and the second superimposed auxiliary sheets are in turn folded on the lateral sheet (52) in a manner such that said lateral sheet can define a lateral wall (104) outside the case (102) while the first auxiliary sheet (79*a*) defines the internal panel (10*b*) of the same case. In a further aspect in accordance with any one of the preceding aspects, following the folding of the first and second auxiliary sheet, said further sheet (78)—optionally said first and a second further sheet (78*a*, 78*b*)—defines the selector on which the first coupling portion is defined.

In a further aspect in accordance with any one of the preceding aspects the process provides for at least one step of arranging at least one release portion (17). In a further aspect in accordance with any one of the preceding aspects the step of arranging the release portion (17) comprises at least one step of defining a notch (59) of at least one lateral sheet (52) of the first blank configured for defining the through access (18). In a further aspect in accordance with any one of the preceding aspects the notch (59) is of the type passing through the lateral wall (52), said notch being executed on the lateral wall (52) directly integrally joined with a peripheral sheet (53).

In a further aspect in accordance with any one of the preceding aspects the central sheet (71) of the second blank (70) has a rectangular shape, wherein the second blank (70) comprises a lateral sheet (72) for each side of the central sheet (71), optionally each lateral sheet also has a rectangular shape, the folding of the lateral sheets (72) of the second blank (70) defining the front wall, the rear wall, the first and the second lateral part (4*c*, 4*d*) of the container (1), the central sheet (71), following the folding of the lateral sheets (72), of the second blank (70) defining the bottom wall (9) of the container.

In a further aspect in accordance with any one of the preceding aspects the step of defining the second coupling portion comprises:

- arranging a peripheral sheet (73) integrally joined with at least one of said lateral sheets (72) of the second blank (70), said peripheral sheet (73) of the second blank (70) emerging from a perimeter edge of at least one lateral sheet (72) of the second blank (70) itself on the side opposite the central sheet (51) of the second blank,
- folding said peripheral sheet (73) above said lateral sheets (72) of the same second blank (70) with which said peripheral sheet (73) is integrally joined,
- constraining, e.g. by means of gluing, said peripheral sheet folded on the lateral sheet (72) of the same second blank (70) with which said peripheral sheet (73) is integrally joined.

In a further aspect in accordance with any one of the preceding aspects, wherein the step of defining the second coupling portion (13) comprises a step of executing a through notch (76) of one of said lateral sheets (72) of the second blank (70) in order to define, directly on said lateral sheet, the panel (13*a*) of the second coupling portion (13). In a further aspect in accordance with any one of the preceding aspects the second blank (70) comprises at least one connection sheet (75) which integrally joins two adjacent lateral sheets (72). In a further aspect in accordance with any one of the preceding aspects wherein, following the folding of the lateral sheets (72) of the second blank (70), two adjacent lateral sheets are stably constrained, e.g. by means of gluing, in a manner such that the container (1) can stably maintain a three-dimensional configuration. In a further aspect in accordance with any one of the preceding aspects wherein the process also comprises, simultaneously with the folding of the lateral sheets (72) of the second blank, the superimposition and joining, e.g. by means of gluing, of the connection sheet (75) to folded adjacent lateral sheets (72).

In a further aspect in accordance with any one of the preceding aspects the process also comprises a step of defining, on the lateral sheet (52) of the first blank (50), directly joined with the peripheral sheet (53), of at least one through cut (57) adapted to define the through opening (48) of the case (102).

In a further aspect a method is provided for closing a package in accordance with any one of the preceding aspects, said closing method comprising the following steps:

- positioning the case (102) outside the container (1) such that the latter can be at least partly housed in the internal volume of the case (102),
- moving the case (102) and the container (1) relatively with respect to each other to define the closed condition,
- optionally arranging at least one between the first and the second coupling portion (12, 13) in the first operative position so as to allow the engagement thereof and the consequent definition of the locking condition.

In a further aspect in accordance with any one of the preceding aspects wherein—before the step of positioning the case (102) outside the container (1)—said case and container are completely separate and distinct from each other. In a further aspect in accordance with any one of the preceding aspects wherein the relative movement between case and container provides for the relative translation of the case (102) with respect to the container up to an end stop position wherein the top wall (109) of the case (102) is abutted against the free edge (6) of the container (1). In a further aspect in accordance with any one of the preceding aspects wherein the first coupling portion is arranged in the first operative position before defining the closed condition.

In a further aspect, a method is provided for opening a package in accordance with any one of the preceding aspects, said opening method comprising the following steps:

- moving, in the locking condition and from outside the package (100), at least one between the first and the second coupling portion (12, 13) into the second operative position so as to disengage the first and the second coupling portion (12, 13),
- following the step of disengaging the first and the second coupling portion (12, 13), relatively moving away the container (1) and the case (102) up to attaining the open condition of the case (102).

In a further aspect in accordance with the preceding aspect, wherein the step of movement of the first and/or second coupling portion (12, 13) occurs from outside the package (100) through the through opening (48). In a further aspect in accordance with any one of the preceding aspects, the disengagement step provides for moving the first coupling portion (12) relative to the case.

In a further aspect, a use of the package is provided in accordance with any one of the preceding aspects for containing products comprising at least one selected in the group from among: drugs, cosmetics, detergents for linens/sheets, detergents for dishes, foods, cigars, cigarettes.

BRIEF DESCRIPTION OF THE DRAWINGS

Several embodiments and several aspects of the finding will be described hereinbelow with reference to the enclosed drawings, provided only as a non-limiting example wherein.

DEFINITIONS AND CONVENTIONS

Figure 1:
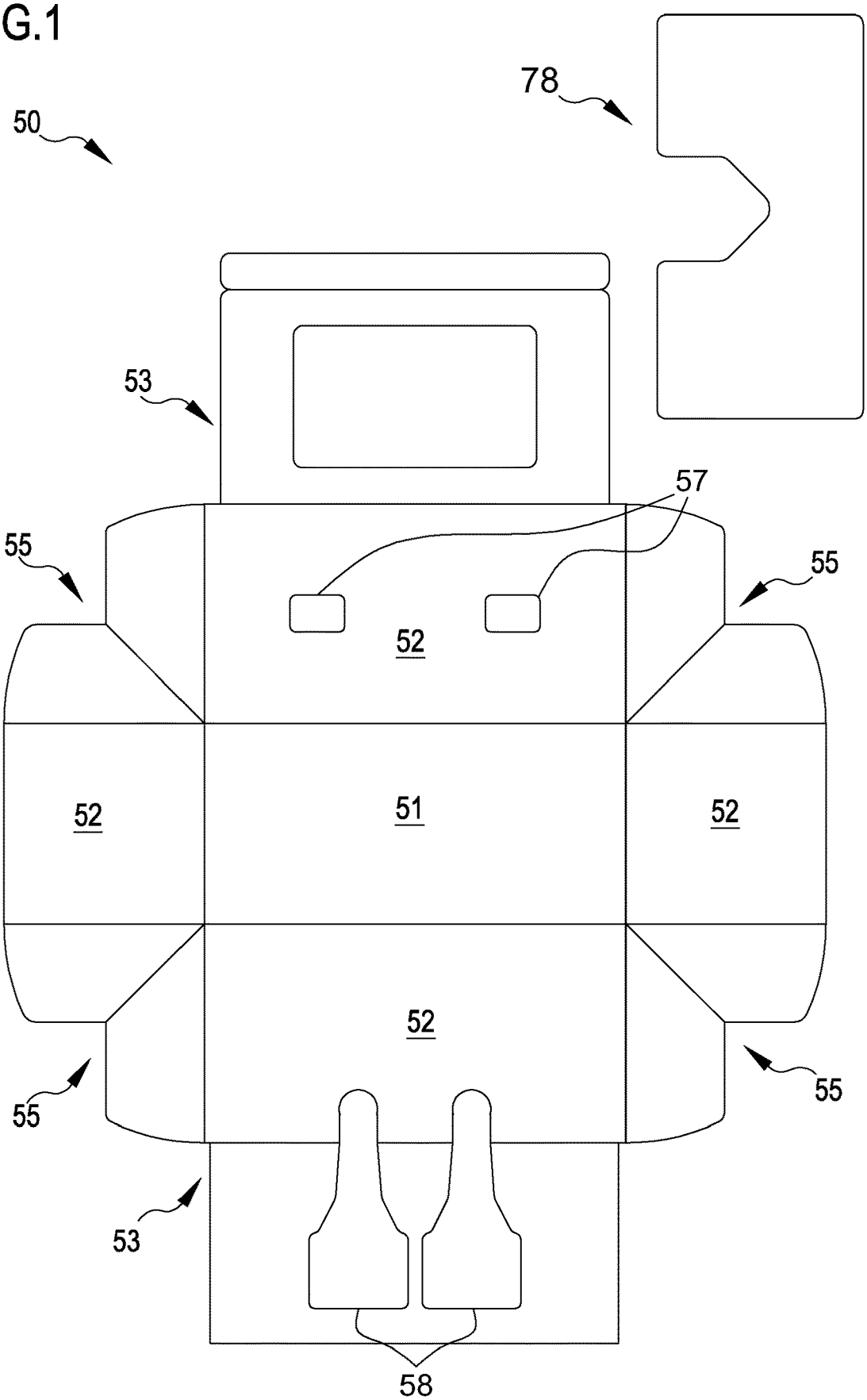
FIGS. 1 and 2 respectively illustrate a blank for making a case and a container of a package in accordance with the present invention.

It is observed that in the present detailed description, corresponding parts illustrated in the various figures are indicated with the same numeric references. The figures could illustrate the object of the invention by means of representations that are not in scale; therefore, parts and components illustrated in the figures relative to the object of the invention might only regard schematic representations.

With the term "product" it is intended an article or a compound of articles of any kind. For example, the product can be in the solid state, liquid state or in gel form, or in the form of two or more of the aforesaid aggregation states. The product can also be intended as a package, e.g. a blister, carrying a plurality of articles. The product can comprise: The product can comprise: drugs, cosmetic products, capsules for dishwashers and washing machines, cleaning products for the home and for linens/sheets (e.g. detergents), foods and cigarettes.

With the term "paper material" it is intended paper or cardboard, e.g. having at least 50% by weight, optionally at least 70% by weight, of organic material comprising one or more from among cellulose, hemicellulose, lignin, lignin derivatives. The paper material can be made of sheet material having a basis weight comprised between 100 and 500 g/m$^2$. The paper sheet material can be covered at least partly by means of a coating made of plastic material, e.g. a film, whose object is that of: reinforcing the paper sheet material, defining a water and/or moisture barrier. The coating can have a thickness variable between 10 and 50 μm and can be made with one or more of the following materials: LDPE, HDPE, PP, PE.

The term "blank" refers to a flat semifinished product made of sheet material, for example made of paper sheet material, foldable on itself in order to make the package. The blank can be made of a single piece and obtainable by means of die cutting a single sheet.

With the expression "folded configuration of the blank" it is intended a configuration in which the blank has been folded to form the container.

With the term "sheet material" it is intended a material that has two dimensions, for example the length and the width, considerably greater than a third dimension, such as the thickness.

With the term "opening device" it is intended any one tool usable by a user for opening the package. For example, the opening device can comprise at least one selected from the group between: a body made of sheet material e.g. a payment card, a loyalty card or a suitable key), an elongated body (e.g. a pen or a suitable key).

With the term "manually intervening" or "manual intervention" referred to the user, it is intended a manual action performed by the user without the aid of tools, such as an opening device. With manual action it is therefore intended the intervention of the user by means of his/her hands directly on the container.

DETAILED DESCRIPTION

Package 100

With 100, a child-proof package for containing products was indicated in its entirety. Such package can have application in the fields which require, for safety reasons, preventing the opening of the same package by children; for example, the package 100 can be employed for containing: drugs, cosmetics, cleaning products (detergents for linens/sheets and dishes), foods and tobacco-based products (cigars and cigarettes).

As is visible for example from FIGS. 5, 7-10 and 16, the package 100 comprises a container 1 made of sheet material, e.g. made of paper material, defining a compartment 3 for housing at least one product. The container 1 has a predetermined number of lateral walls 4 defining at least one opening 5 delimited by a free edge 6: the opening 5 is configured for allowing the insertion and picking up of the product from the container 1.

The container 1 can have a quadrangular prismatic shape as illustrated in the enclosed figures, even if not excluding the possibility to make a container 1 having different shape, e.g. square, trapezoidal or cylindrical shape. In detail, the container 1 can comprise a front lateral wall 4*a* and a rear lateral wall 4*b* facing and parallel to each other: the front wall 4*a* and the rear wall 4*b* are connected to each other by means of a first and a second lateral wall 4*c*, 4*d*, also facing and parallel to each other. the front wall 4*a* is distanced from and opposite the rear wall 4*b*; the first and second lateral wall 4*c*, 4*d* are also distanced and opposite each other. The ends of the front, rear and lateral walls (4*a*, 4*b*, 4*c*, 4*d*) define the opening 5, delimited by the free edge 6.

The container 1 also comprises a bottom wall 9 (FIGS. 6 and 9) having rectangular shape and from which, starting from a perimeter edge of the bottom wall 9, the lateral walls 4 and in particular the front wall 4*a*, the rear wall 4*b* and the first and second lateral walls 4*c*, 4*d* emerge. The container 1 then comprises a single opening 5 defined opposite the bottom wall 9. However, the possibility of making a container 1 having two or more openings 5 cannot be excluded. The compartment 3 of the container can have a volume greater than 40 $cm^3$, optionally greater than 100 $cm^3$ as a function of the products to be contained. For example, if the container 1 is used for containing medium-size products, the compartment 3 can have a volume comprised between 800 and 1400 $cm^3$. For large-size products, the compartment 3 can reach volumes greater than 10,000 $cm^3$.

The package 100 also comprises a case 102, that can also be made of sheet material, e.g. paper, and having a predetermined number of lateral walls 104 defining at least one access 105 delimited by a free edge 106 configured for allowing the passage of the container 1. The predetermined number of lateral walls 104 of the case 102 delimits an internal volume 103 configured for receiving at least part of the container 1; in fact, the access 105 is configured for placing in communication the internal volume 103 with the external environment, as well as allowing the insertion and the removal of the container 1 from said internal volume 103. The case 102 and the container 1 are defined by elements that are distinct and completely separable from each other. In particular, case 102 and container 1 are relatively movable with respect to each other at least between:

- a closed condition in which the case 102 obstructs the opening 5 of the container 1, and
- an open condition in which the case 102 allows the communication between the compartment 3 and the external environment.

The relative movement between case and container can be obtained by moving both the parts, i.e. both the case and the container or it can be obtained by means of the movement of only one of the parts: for example it is possible to maintain the container fixed and only move the case relative to the container.

In detail, the container 1, in the closed condition (schematized for example in FIGS. 5-9, 15 and 16), is at least partly arranged in the internal volume 103: the case 102, in such condition, prevents the insertion and picking up of products from the container. In the open condition, the case 102 is completely separate (distanced) from the container 1. During the passage from the closed condition to the open condition, and vice versa, container 1 and case 102 relatively slide with respect to each other close to or away from each other: during such relative movement, the container is placed at least partly within the case and relatively translates (by movement of at least one between said container and case) in a manner such that the bottom wall 9 of the container 1 and the top wall 109 of the case 102 are moved close to or away from each other.

The case 102 has a structure at least partly counter-shaped with respect to the container 1 in a manner such that, in the closed condition, the case 102 is fit outside the container 1. In detail, the case 102 comprises a front wall 104*a* and a rear wall 104*b* opposite each other and connected by means of a first and a second lateral wall 104*c* and 104*d*, also distanced and opposite each other. In detail, also the case 102 has a rectangular prismatic shape: the front wall 104*a* and the rear wall 104*b* (with square or rectangular shape) are facing and parallel to each other and connected to each other by means of the first and of the second lateral wall 104*c*,104*d* (with square or rectangular shape) also facing and parallel to each other. In the closed condition:

- the front walls 4*a*, 104*a*, respectively of the container and of the case, directly face each other,
- the rear walls 4*b*, 104*b*, respectively of the container and of the case, directly face each other,
- the first lateral walls 4*c*, 104*c*, respectively of the container and of the case, directly face each other,
- the second lateral walls 4*b*, 104*d*, respectively of the container and of the case, directly face each other.

However, the possibility of making a case 102 having different form, e.g. with trapezoidal section, cannot be excluded. As is visible for example in FIGS. 6, 9, 15 and 16, the case 102 also comprises a top wall 109 having rectangular shape and from which, starting from a perimeter edge of the top wall 109, the lateral walls 104 and in particular the front wall 104*a*, the rear wall 104*b* and the first and second lateral walls 104*c*, 104*d* emerge. The case 102 then comprises a single access 105 defined opposite the top wall 109. However, the possibility of making a case 102 having two or more accesses 105 cannot be excluded; for example, the case 102 could have an access 105 on at least one of the lateral walls 104*c*, 104*d* of the same case 102. The top wall 109 is configured for being abutted, in the closed condition, against the free edge 6 of the opening 5 in order to obstruct the latter, as is visible in FIG. 5.

As mentioned above, the case 102 is counter-shaped with respect to the container 1. The counter-shaped configuration of container 1 and case 102 allows the lateral walls of the case 102 to slide (relatively) externally side-by-side the lateral walls 4 of the container 1 during the passage from the closed condition to the open condition and vice versa. In order to allow such relative movement, the case 102 has a size slightly greater than the container 1, sufficient to allow the insertion of the latter in the internal volume 103.

Figure 3:
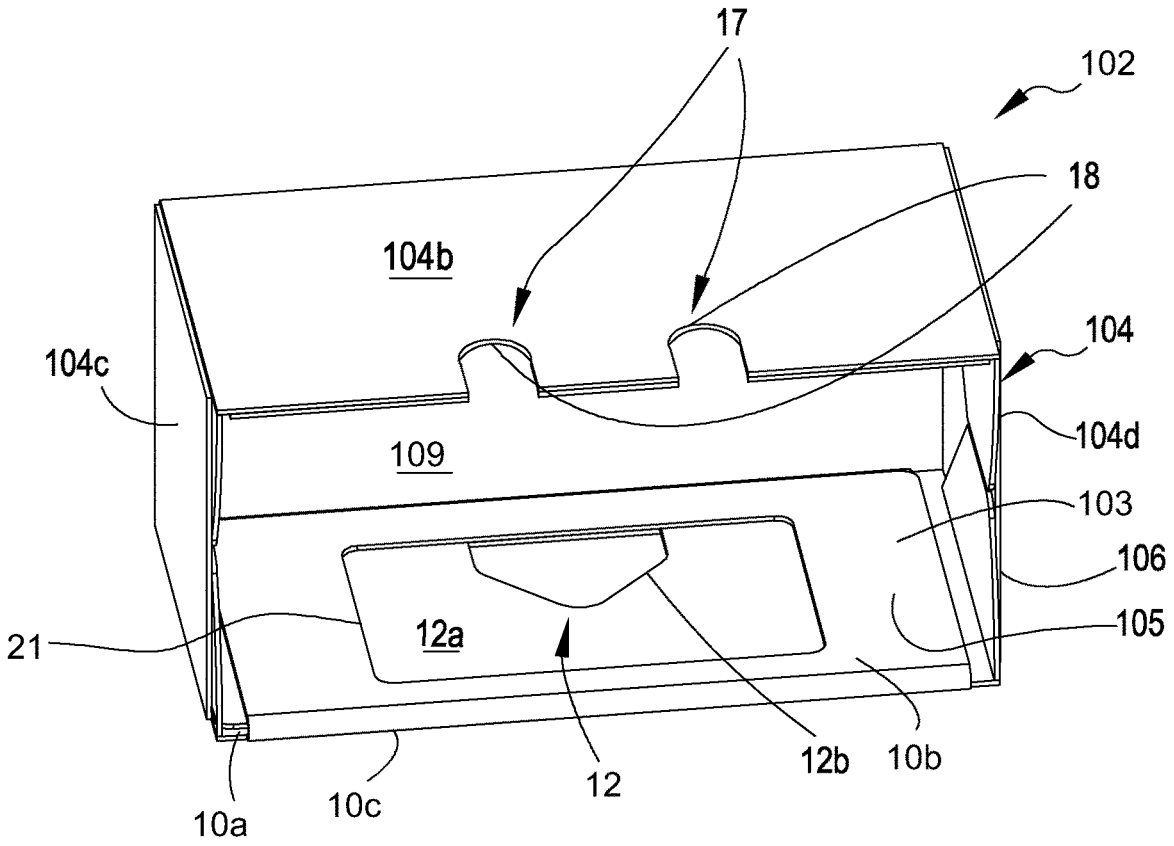
FIG. 3 is a perspective view of a case of a package in accordance with the present invention.
Figure 4:
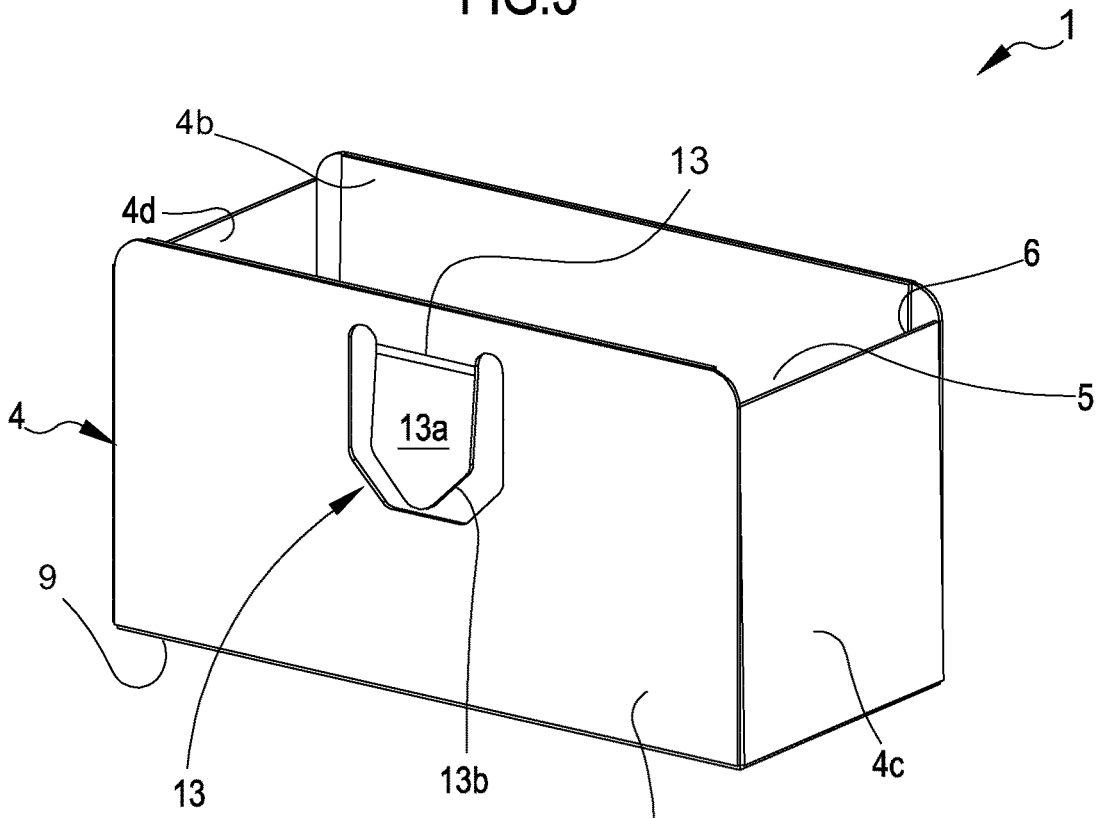
FIG. 4 is a perspective view of a container of a package in accordance with the present invention.
Figure 6:
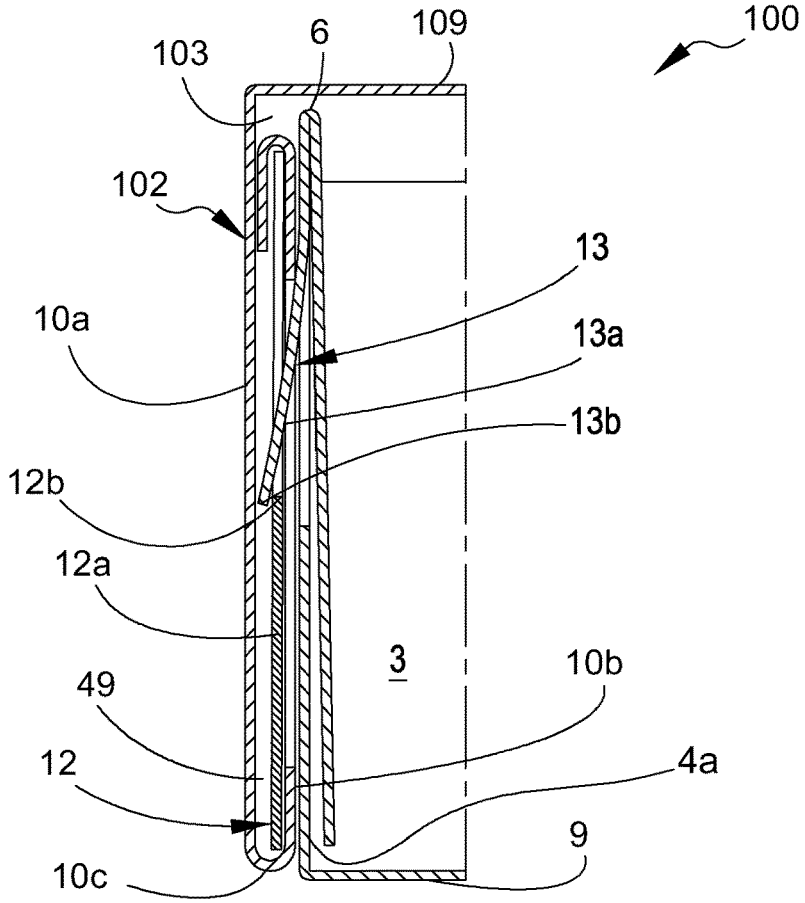
FIG. 6 is a section view, according to the trace VI-VI, of the package of FIG. 5.
Figure 13:
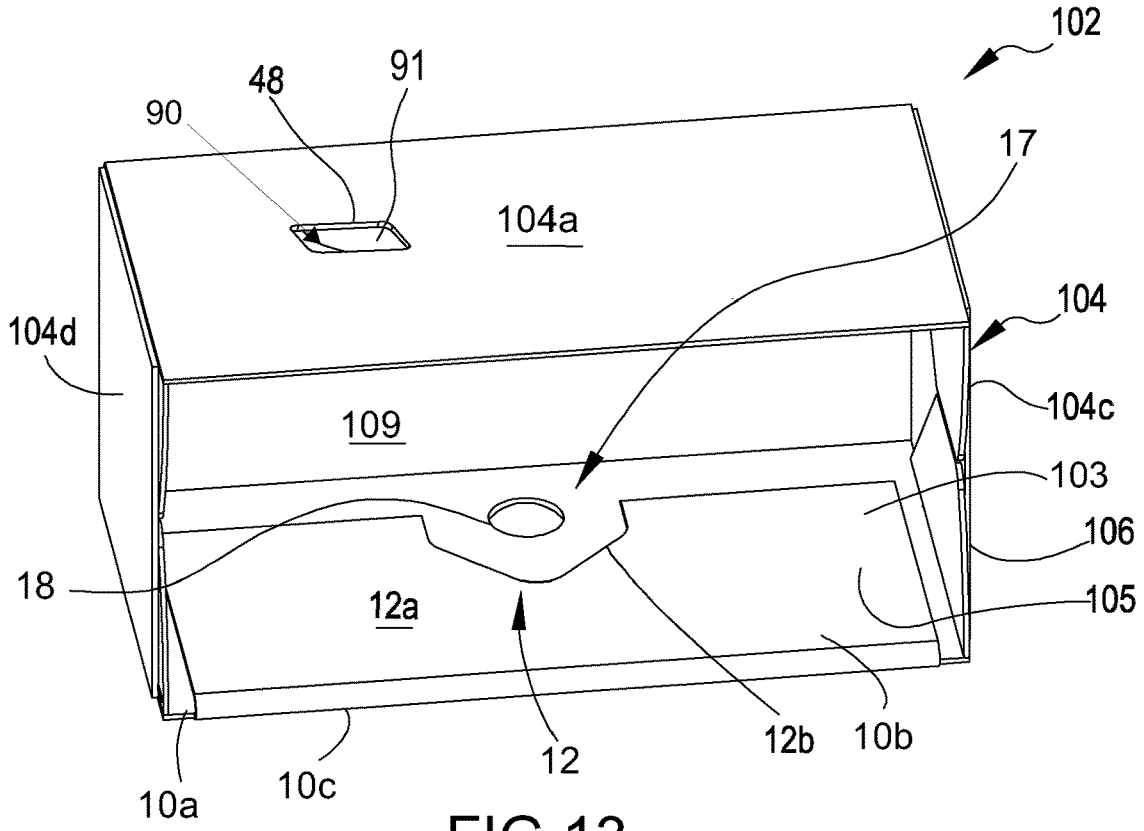
FIG. 13 is a further perspective view of a case of a package in accordance with the present invention.

As for example in FIGS. 3 and 13, the case 102 can comprise at least one external panel 10*a* and an internal panel 10*b* defining a seat 49 (FIG. 6). The external panel 10*a* defines at least part of a lateral wall of the case 102; in particular, in the embodiment illustrated in the enclosed figures, the external panel 10*a* defines at least part of the front wall 104*a*; it may be possible to provide for a case in which one or more lateral walls are defined by a respective external panel 10*a* with which an internal panel is connected, arranged in the internal volume 103. The internal panel 10*b*, in the closed condition, is arranged in interposition between the container 1 and the external panel 10*a*. The external panel and the internal panel 10*a*, 10*b* can be integrally joined at a folding edge 10*c* and facing each other to define a folded portion; the folding edge 10*c* of the external panel 10*a* and internal panel 10*b* defines at least part of said free edge 106 of the case 102. External and internal panels 10*a*, 10*b* face each other and substantially lie on a plane parallel to each other.

The package 100 also comprises a safety device 11 comprising:

- at least one first coupling portion 12 carried by the case 102 and at least partly arranged in the internal volume 103,
- at least one second coupling portion 13 carried by the container 1 and arranged outside the compartment 3.

At least one between the first and the second coupling portion 12, 13, at least in the closed condition between the container and the case, is movable relative to the other between the first and the second coupling portion 12, 13 at least between:

a first operative position in which the first and the second coupling portion 12, 13 are configured for being stably engaged with each other to define a locking condition of the safety device 11 in which said first and second coupling portion 12, 13 prevent case and container from passing from the closed condition to the open condition, a second operative position in which the first and the second coupling portion 12, 13 cannot be engaged with each other in a manner such that case and container can freely pass from the closed condition to the open condition.

In fact, the first coupling portion 12 can be movable relative to the case 102 and/or the second coupling portion 13 can be movable relative to the container, at least in the closed condition of the case and the container.

The first coupling portion 12 is carried by at least one lateral wall 104 of the case 102 and comprises at least one tab 12*a* defining an undercut delimited by at least one gripping edge 12*b* placed entirely in the internal volume 103, distinct and distanced from the free edge 106 of the access 105. The gripping edge 12*b* of the tab 12*a* is at least for one section tilted with respect to the free edge 106 of the access 105 optionally by an angle comprised between 20° and 80°, still more optionally by an angle comprised between 30° and 70°. In detail, the tab 12*a* is extended along a plane and directly faces the lateral wall 104 of the case directly carrying the tab 12*a*. The tab 12*a* is extended substantially along a plane substantially parallel to the lateral wall of the case directly carrying said first coupling portion 12. The at least one tab is entirely facing and superimposed on the lateral wall 104 of the case directly carrying said tab 12*a*. As mentioned above, the safety device 11 can comprise at least one first coupling portion 12. In detail, the safety device 11 can comprise at least one from among:

at least one of said first coupling portion 12 carried by the front wall 104*a* of the case 102, at least one of said first coupling portion 12 carried by the rear wall 104*b* of the case 102, at least one of said first coupling portion 12 carried by the first lateral wall 104*c* of the case 102, at least one of said first coupling portion 12 carried by the second lateral wall 104*c* of the case 102.

In the enclosed figures, a non-limiting configuration of the invention is illustrated wherein the safety device 11 comprises a first coupling portion 12 carried by the front wall 104*a* and a first coupling portion 12 carried by the rear wall 104*b*. Of course, the possibility of arranging two or more first coupling portions on the same lateral wall and/or at least one first coupling portion for each lateral wall 104 of the case 102 cannot be excluded.

As mentioned above, the safety device comprises at least one second coupling portion 13. In particular, the safety device 11 could comprise only one second coupling portion 13 configured for cooperating with one or more of said first coupling portions 12. Alternatively, the safety device 11 can comprise a second coupling portion 13 for each first coupling portion 12.

The second coupling portion 13 can comprise a panel 13*a* directly integrally joined with at least one of said lateral walls 4 of the container 1 and at least partly folded above the latter. The panel 13*a* is at least partly superimposed and facing the lateral wall 4 with which said panel 13*a* is directly connected (integrally joined). Even if the panel 13*a* is integrally joined with the lateral wall 4, only a part of said panel 13*a* defines the undercut adapted to cooperate with the first coupling portion 12: the gripping edge 13*b* is always distinct and distanced from the free edge 6 of the opening 5. In fact, in such configuration the at least one panel 13*a* of the second coupling portion 13 directly and entirely faces the lateral wall 4 of the container directly carrying said panel 13*a*: the panel 13*a* is entirely superimposed on the lateral wall 4 of the container 1 directly integrally joined with the panel 13*a*, and distanced from the free edge 6.

The second coupling portion 13 can be obtained directly on the lateral wall (external wall of the container) by means of a through cut operation of said lateral wall 4: in this manner, on said lateral wall is possible to extract the panel 13*a* which projects with respect to said lateral wall as illustrated for example in FIGS. 4, 11, 12 and 16. In such configuration, the entire panel 13*a* can be extended from the lateral wall 4, distanced from the free edge 6, away from the latter by an angle lower than 40°, optionally comprised between 1° and 30°, with respect to the lateral wall 4 from which the same panel 13*a* has been obtained. Indeed, also in such configuration (FIG. 4A), the panel 13*a* is defined at least partly within a through notch of the lateral wall 4; the panel 13*a* has an attachment portion 13*c* distanced from the free edge and integrally joined with the lateral wall 4: the panel is extended from said attachment portion 13*c* away from the free edge 6 of the container. In detail, the coupling portion 13, optionally the panel 13*a*, is placed at a minimum distance of the free edge 6 of the container 1 equal to or greater than 5 mm, optionally equal to or greater than 7 mm, still more optionally comprised between 7 mm and 30 mm. Indeed, the minimum distance is measured (defined) by the attachment portion 13*c* of the panel 13*a* to the free edge 6.

Each second coupling portion 13 comprises one and only one panel 13*a* having a substantially triangular shape or in any case pointed shape adapted to cooperate with the first coupling portion 12. As mentioned above, the safety device 11 can comprise at least one second coupling portion 13. In detail, the safety device 11 can comprise at least one from among:

at least one of said second coupling portion 13 carried by the front wall 4*a* of the container 1, at least one of said second coupling portion 13 carried by the rear wall 4*b* of the container 1, at least one of said second coupling portion 13 carried by the first lateral wall 4*c* container 1, at least one of said second coupling portion 13 carried by the second lateral wall 4*c* of the container 1.

In the enclosed figures a non-limiting configuration of the invention is illustrated wherein the safety device 11 comprises two second coupling portions 13 respectively carried by the front wall 4*a* and rear wall 4*b* of the container.

At least one of said first coupling portions is slidably movable relative to the case 102 within the seat 49 defined by the external panel 10*a* and internal panel 10*a*, along a direction substantially parallel to a lying plane of the external panel 10*a*. The tab 12*a*, in the first operative position (condition illustrated in FIG. 5) of the first coupling portion 12, is configured for being engaged with the panel 13*a* of the second coupling portion 13. In detail, the first coupling portion 12, in the first operative position and in the closed condition between the case and the container, is substantially aligned with the second coupling portion and configured for engaging the latter, as illustrated for example in FIG. 7.

The first coupling portion 12, optionally the tab 12*a*, is movable within the seat 49 (FIG. 6) along a direction substantially parallel to the folding edge 10*c* of the external and internal panels. In fact, the first coupling portion 12, during the movement from the first to the second operative position and vice versa (in particular at least during the closed condition of the container and the case), translates relative to the case 102 and to the container 1, substantially maintaining a same distance from the top wall 109 of the case. In other words, the movable first coupling portion 12 is configured for translating relative to the case 102 along a direction substantially parallel to a lying plane of the top wall 109. The first coupling portion 12, during the movement of the first and second operative position and vice versa, is configured for sliding relative to the case in the internal volume of the latter.

Figure 7:
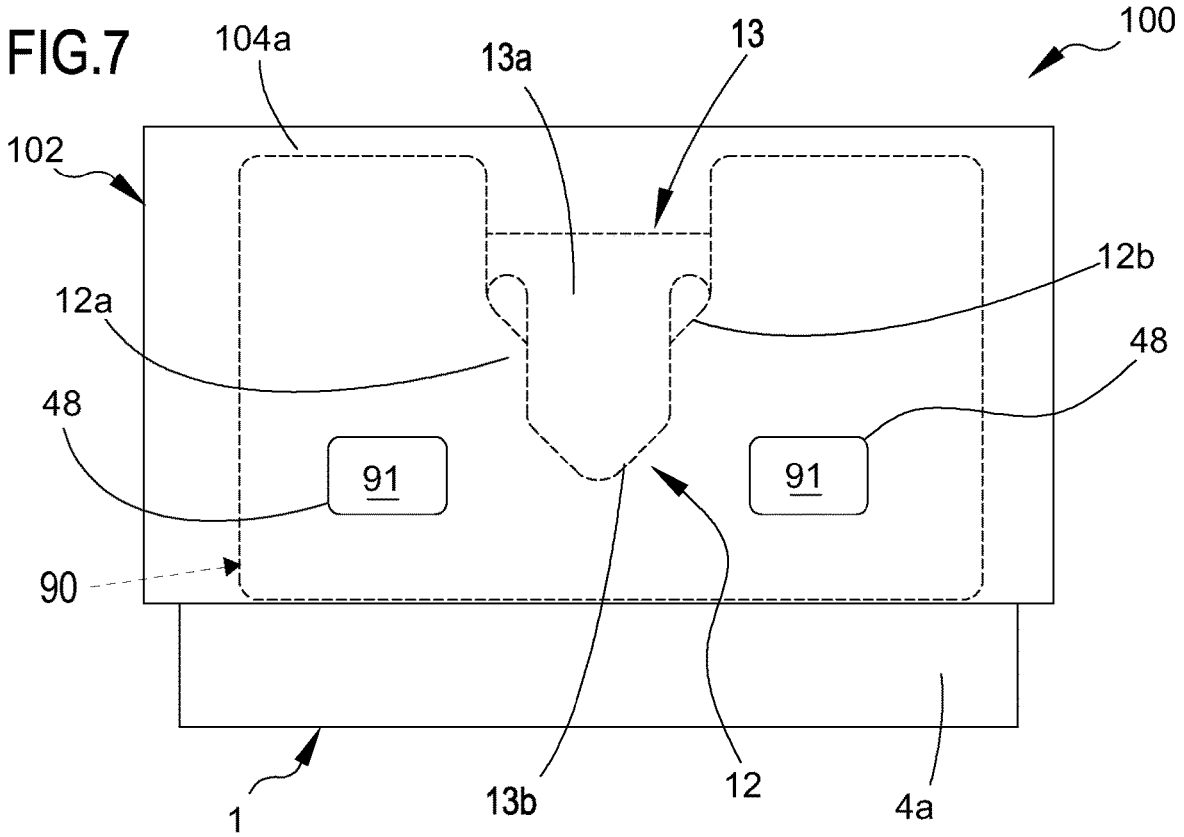
FIGS. 7 and 8 are further front views of a package in accordance with the present invention arranged in different operative conditions.

In detail and as is visible for example in FIG. 3, the internal panel 10*b* has a through pocket 21 configured for allowing the second coupling portion 13, emerging from a lateral wall 4 of the container, to reach and engage, in the closed condition and in the first operative position of the first coupling portion 12, the tab 12*a* (FIGS. 6 and 7).

Figure 8:
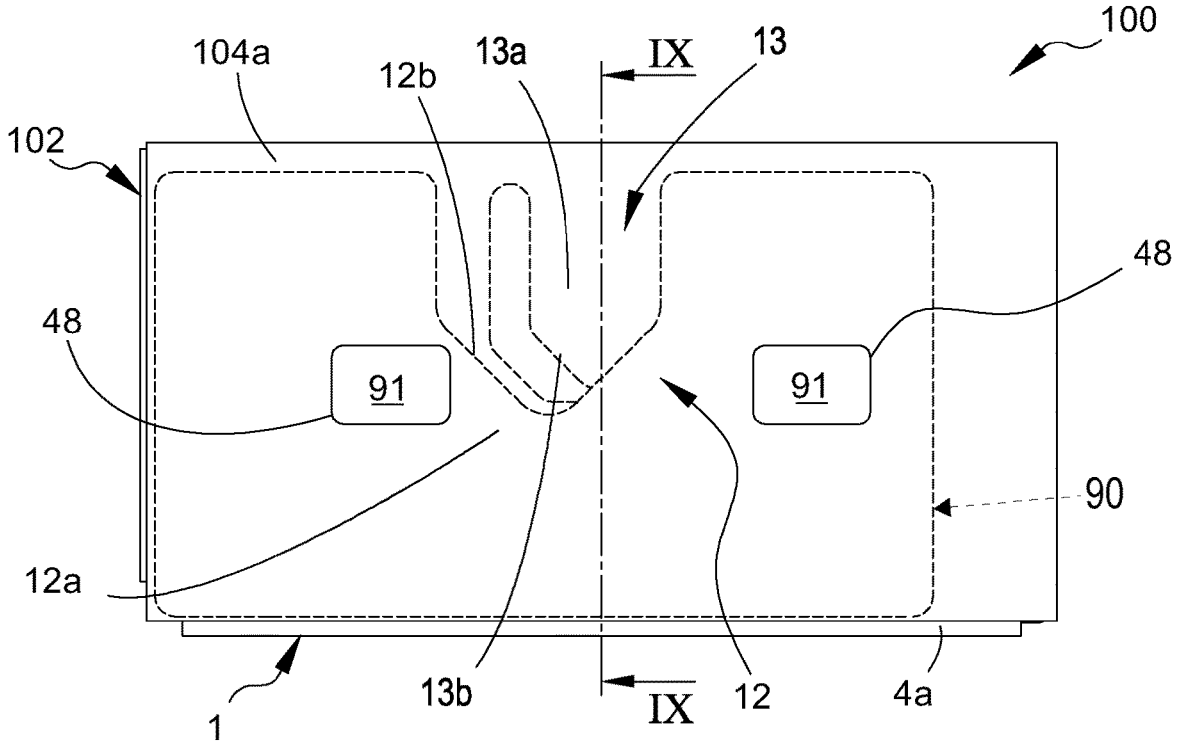
Figure 9:
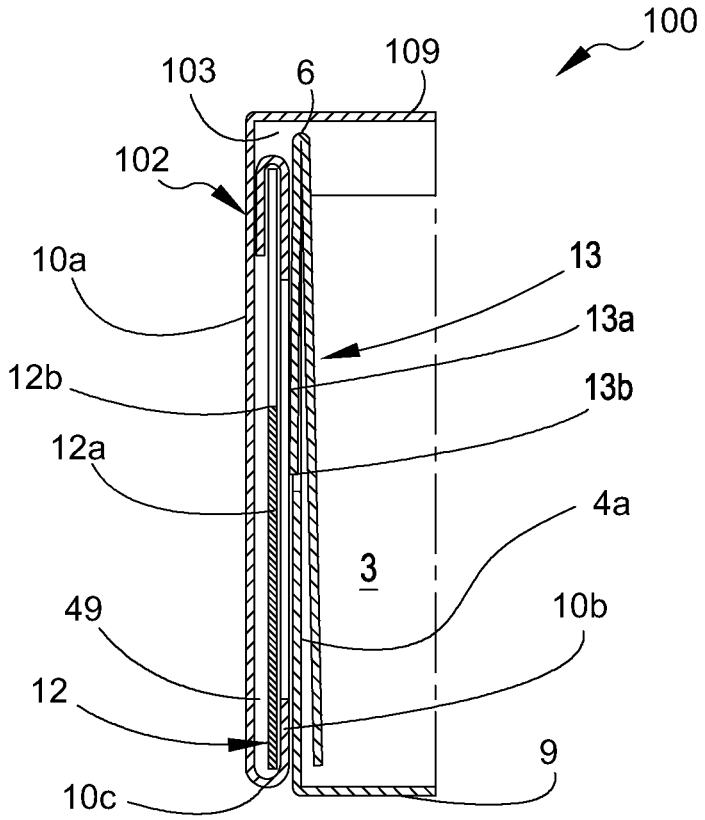
FIG. 9 is a section view, according to trace IX-IX, of the package of FIG. 8.
Figure 10:
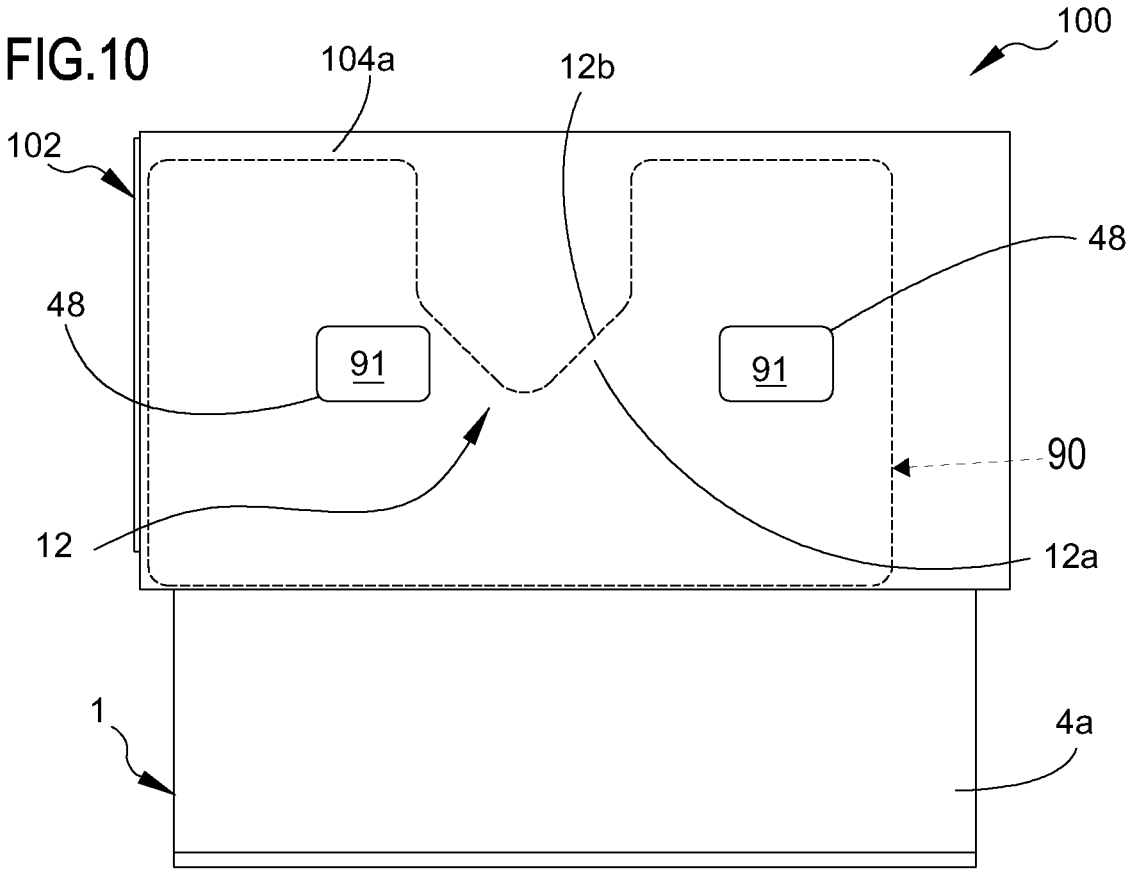
FIG. 10 schematically shows a step for opening the package.

In FIG. 8, instead, a first coupling portion 12 is illustrated arranged in the second operative position wherein first and second coupling portion cannot be engaged with each other, also in the closed condition of the case and the container. In fact, in the second operative position, the first coupling portion 12 is offset with respect to the second coupling portion in a manner such to prevent the tab 12*a* from being engaged, in the closed condition of the case 102 and the container 1, with the panel 13*a*. In fact, in the second operative position of at least one between the first and the second coupling portion 12, 13, the tab 12*a* and the panel 13*a* are offset along a direction parallel to the folding edge 10*c* in a manner such that the undercut defined by the tab 12*a* cannot grip on the undercut defined by the panel 13*a*.

In the configuration illustrated in the enclosed figures, the first coupling portion 12 is movable with respect to the case 102 while the second coupling portion 13 is fixed to the container. The possibility of making a second coupling portion 13, optionally a panel 13*a*, movable relative to the container between the first and the second operative position, and vice versa, cannot be excluded. Also in such configuration, the panel 13*a* can be offset with respect to the tab 12*a* along a direction parallel to a section of the free edge 6 with which the panel 13*a* is directly integrally joined. In the condition in which the panel 13*a* is aligned with the tab 12*a*, these can be engaged with each other, in the closed condition of the case and the container; vice versa, when the panel 13*a* is offset with respect to the panel (hence placed in the second operative position) the undercut of the panel 13*a* does not engage the undercut of the tab. In such configuration, the second coupling portion 13 can be moved relative to the container 1 along a direction substantially parallel to at least one section of the free edge 6 directly carrying the second coupling portion 13 and/or substantially parallel to a lying plane of the bottom wall. In such configuration, the first coupling portion 12 (the tab 12*a*) can be directly integrally joined with at least one lateral wall 104 by means of a folding edge to define a folded portion. The tab 12*a* can be made of a single piece with a lateral wall 104 and folded with respect to the latter in a manner such that the tab is at least partly superimposed on and faces the lateral wall 104 with which said tab is directly connected (integrally joined). In such configuration, the folding edge joining the tab 12*a* and the lateral wall 104, defines at least part of the free edge 106 of the access 105. Even if the tab 12*a* is integrally joined with the lateral wall 104, only a part of this defines the undercut adapted to cooperate with the second coupling portion 13: the gripping edge 12*b* is always distinct and distanced from the free edge 106 of the access 105.

Figure 5:
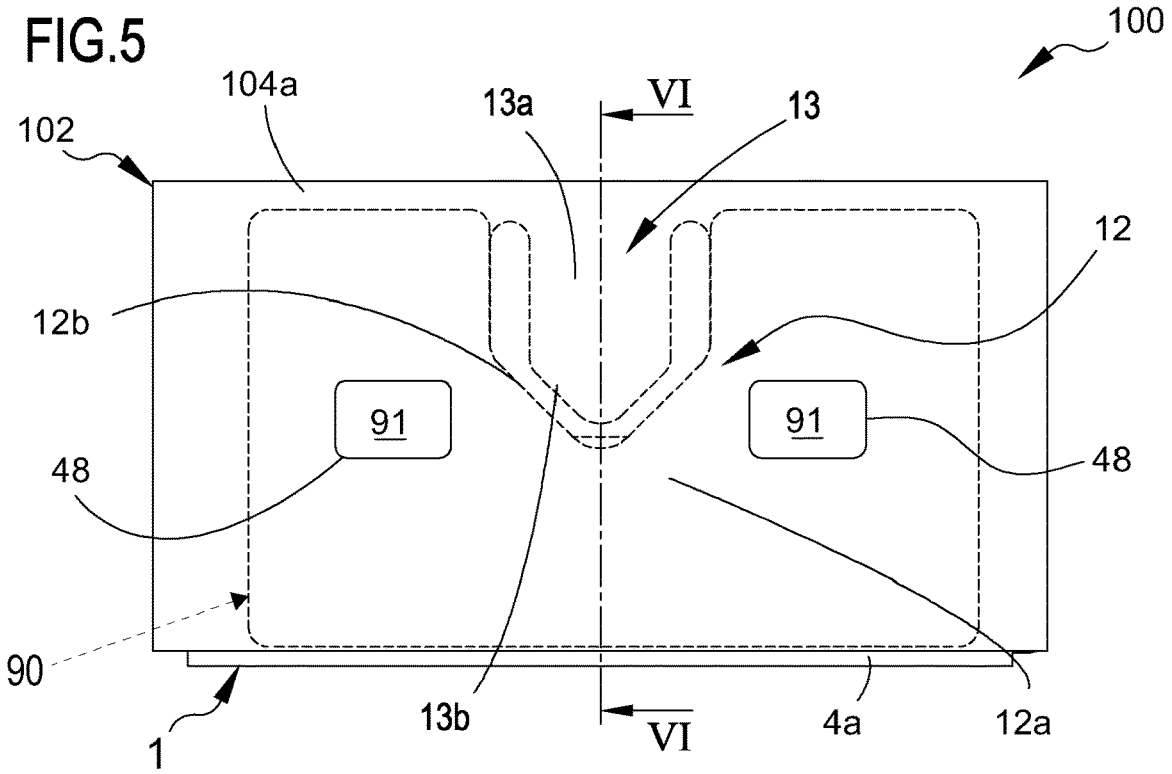
FIG. 5 is a front view of a package in accordance with the present invention.

In the closed condition and in the first operative position of at least one between the first and the second coupling portion 12, 13, the undercut defined by the panel 13*a* of the second coupling portion 13 is stably engaged with the undercut of the at least one tab 12*a* of the first coupling portion 12 to define said locking condition (FIGS. 5-7). In the locking condition, the safety device 11 prevents the case 102 and the container 1 from passing from the closed condition to the open condition. In fact, due to the presence of the first and second coupling portion, the safety device 11 stably maintains the package in the closed condition, preventing access from outside to the products housed in the container 1.

FIG. 7 schematically illustrates the engagement between the first and second coupling portion 12, 13 (locking condition of the safety device 11); as is visible, in the locking condition, the second coupling portion 13 is interposed between the first coupling portion 12 and the lateral wall 104 of the case 102, carrying said first coupling portion, to define an undercut adapted to limit the moving away movement between the case 102 and the container 1 so as to prevent the passage from the closed condition to the open condition.

As mentioned above, the panel 13*a* has a substantially "V" shape whose pointed portion is directed away from the free edge 6. The (end) pointed portion of the "V" is configured for defining an introduction portion adapted to facilitate the engagement with the first coupling portion 12; in detail, the pointed portion is configured for ensuring the connection of the panel 13*a* in interposition between the at least one tab 12*a* of the first engagement portion 12 and the lateral wall 104 carrying said first engagement portion 12.

As is visible in the enclosed figures, the first coupling portion can be defined on a selector 90 made of sheet material interposed between the external panel 10*a* and the internal panel 10*b*: the selector 90 is movable via translation within the seat 49 along a direction substantially parallel to a lying plane of the external panel 10*a* and/or internal panel 10*b*.

The movement of the selector 90 and hence of the first coupling portion 12 can be executed during the closed condition: the selector 90 is movable between a first and a second operative position substantially coinciding with the first and second operative positions of the first coupling portion 12.

As is visible in the enclosed figures, the case 102 has at least one through opening 48 configured for allowing a user, in the closed condition of the case and the container and from outside the package, to contact at least one between said first and second coupling portion in order to allow the movement thereof from the first to the second operative position, and vice versa. The user can manually contact the movable first and/or the second coupling portion in order to push such movable portion between the first and the second operative position. In any case the possibility that user can contact the movable coupling portion (first and/or second coupling portion) through the through opening 48 by means of an opening device or key cannot be excluded.

The through opening 48 is configured for placing in communication, at least in the closed condition of the container and the case, the internal volume 103 of the case 102 and the external environment the package. In detail, the through opening 48 is defined on the lateral wall of the case directly carrying the first coupling portion 12 (in the configuration illustrated in the enclosed figures, the through opening is defined on the front wall 104*a* carrying the first coupling portion 12).

As is visible in the enclosed figures, the movable coupling portion (first and/or second coupling portion 12, 13) comprises at least one handling portion 91 configured for allowing the user to move the movable coupling portion from the first to the second operative position, and vice versa. As is visible, the handling portion 91 faces the at least one through opening 48 of the case. The case 102 can comprise two through openings 48; the movable coupling portion can comprise two respective handling portions configured for facing a respective access opening 48. For example, an access opening 48 can be configured for allowing the display and the contact of only one handling portion for the movement of the movable coupling portion from the first to the second operative position while the other through opening can be configured for allowing the display and the contact of the other handling portion for the movement of the movable coupling portion from the second to the first operative position. Each through opening 48 is distinct and separate from the free edge of the case 102, optionally it is defined in interposition between the top wall 109 and the free edge of the case.

In the enclosed figures, illustrated in a non-limiting manner, a package 100 in which the through opening 48 is defined on the front wall 104*a* of the case 102 and allows intervening on the first movable coupling portion 12 (optionally on the selector 90) slidably engaged between the external and internal panels 10*a*, 10*b*.

As is visible in the enclosed figures, the package 100 can also comprise a further safety device comprising a first and a second coupling portion 12, 13 substantially identical in the structure to the above-described coupling portions 12, 13 and which are fixed (optionally integrally joined) to the case and to the container. The first and the second coupling portion 12, 13 of the further safety device can be disengaged by means of a release portion 17 (FIG. 3) configured for defining at least one through access 18 on at least one lateral wall 104 of the case 102, at the first and second coupling portion 12, 13 of the further safety device: the release portion 17 is configured for allowing, at least in the locking condition of the further safety device, the direct access from outside the package to at least one between said first and second coupling portion 12, 13 in order to allow the disengagement thereof.

In detail, the release portion 17 is configured for allowing a user, at least in the locking condition of the safety device 11, to intervene from outside the package 100 directly on at least one of said first and second coupling portions 12, 13 of the further safety device manually and/or by means of an opening device insertable through the through access 18 definable by said release portion. In still more detail, the release portion 17 is configured for allowing, at least in the locking condition of the further safety device, intervention from outside the package 100 directly on the panel 13*a* of at least one of said second coupling portions 13. The release portion 17 can comprise, in a non-limiting manner, a through access 18 defined on at least one lateral wall 104 of the case 102: the through access 18 is configured for allowing the communication between external environment and the internal volume 103. Alternatively, the release portion 17 could comprise a deformable portion placed, in the locking condition, across from the first and the second coupling portion 12, 13 of the further safety device: in such configuration, the release portion 17 essentially comprises a thrust portion configured for being moved (manually by the user or by means of an opening device) between a thrust position and a rest position. In the rest position, the thrust portion is distanced from the safety device, while in the thrust position the thrust portion operates on the safety device in order to allow the disengagement between the first and the second coupling portion 12, 13. In fact, the thrust portion can functionally act as a button. The thrust of a finger of a user on the thrust portion according to a direction entering the package allows the thrust portion to come into contact with the second coupling portion 13, disengaging it from the undercut of the first coupling portion 12. The thrust portion can be reversibly movable between the thrust position and the rest position. For such purpose, the thrust portion can be elastically deformable between the thrust position and the rest position. If the safety device 11 is present, having at least one movable coupling portion and the further safety device, the package can be opened following the disengagement of the first and second coupling portions of all the safety devices present on the package.

Manufacturing Process

Also forming the object of the present invention is a process of making a package 100 in accordance with one or more of the enclosed claims and/or in accordance with the above-reported description.

The process provides for arranging the case 102 attainable by means of a first flat blank 50 made of sheet material, optionally paper. The first blank 50 comprises:

- a central sheet 51,
- a predetermined number of lateral sheets 52 integrally joined with the central sheet 51 and emerging from the latter starting from a perimeter edge,
- at least one peripheral sheet 53 engaged with at least one of said lateral sheets 52.

The central sheet 51 has a polygonal shape, optionally rectangular or square. From each side of the central sheet 51, a lateral sheet 52 is extended, also having a polygonal shape, optionally rectangular or square.

The arranging of the case 102 comprises the sub-step of folding the predetermined number of lateral sheets 52 in order to define the predetermined number of lateral walls 104 of the case 102. In detail, the lateral sheets are folded with respect to the central sheet 51 in a manner such that from the flat blank it is possible to obtain a case having three-dimensional conformation. The lateral sheets 52 are constrained with each other in a manner such that the case 102 can maintain its three-dimensional form; the lateral sheets 52 can be constrained directly with each other by means of glue or any one adhesive material. Alternatively, the blank 50 can be provided with at least one connection sheet 55 which integrally joins two adjacent lateral sheets 52 (FIG. 1); in such configuration, the process—simultaneously with the folding of the lateral sheets 52—provides for the superimposition and joining, e.g. by means of gluing, of the connection sheet 55 to folded adjacent lateral sheets: in this manner, the case can maintain its three-dimensional form with the lateral sheets 52 which define the lateral walls 104 and the central sheet to define the top wall 109.

The process also provides for defining the external panel 10*a* and internal panel 10*b* by means of a step of folding the at least one peripheral sheet 53 on the lateral sheet 52 integrally joined with said peripheral sheet. FIG. 1 illustrates a first blank 50 comprising two opposite peripheral sheets 53. The possibility of providing for one or more peripheral sheets integrally joined and emerging from each lateral sheet 52 cannot be excluded. The step of arranging the first coupling portion 12 comprises:

- the folding of the peripheral sheet 53 of the first blank 50 above the lateral sheet 52 of the same first blank 50 with which said peripheral sheet 53 is integrally joined, in a manner such that the peripheral sheet defines the internal panel 10*b* and the lateral sheet 52 the external panel 10*a* with which said internal panel is directly integrally joined, arranging a further sheet 78 in interposition between said peripheral sheet 53 and lateral sheet 52 folded, said further sheet 78 being distinct from the peripheral sheet and from the lateral sheet and is movable with respect to the latter, said further sheet defining the first mobile coupling portion 12 relative to the case.

Following the folding of the peripheral sheet, at least one part of this is constrained, e.g. by means of gluing, to a part of the lateral sheet with which it is directly integrally joined (directly to the lateral wall 104). The folding of the at least one peripheral sheet 53 can be executed before, simultaneously or after the folding and constraining of the lateral sheets 52.

The central sheet 51, the lateral sheets 52 and the peripheral sheets 53 of the first blank 50 can be integrally joined to define a single blank made of a single piece, for example at least partly made of paper material. The case 102 is thus obtainable by means of steps of folding and gluing a single sheet blank (first flat blank 50). The first blank can be obtained by means of one or more steps of die cutting a single precursor sheet.

The process also comprises a step of defining, on the lateral sheet 52 of the first blank 50, directly joined with the peripheral sheet 53, at least one through cut 57 adapted to define the through opening 48 of the case 102 through which it is possible to contact and move at least one between the first and the second coupling portion 12, 13. As described above, the case 102 can also have the release portion 17 which can be obtained by means of arranging a notch 59 of at least one lateral sheet 52 of the first blank 50: the notch 59 is of the type passing through the lateral wall 52 and is executed on the lateral wall 52 carrying the peripheral sheet 53.

The process can also provide or a step of providing the selector 90 which comprises a step of cutting a base semi-finished sheet made of sheet material, optionally flat: the cutting step defining the shape of the selector. The selector 90, following the formation thereof, is inserted in interposition between a lateral sheet 52 and a peripheral sheet 53 of the first blank folded with respect to each other: in such condition, the selector is situated between an external lateral wall of the case defined by the folded lateral sheet 52 and the internal panel 10*b* of the same case defined by the peripheral sheet 53 folded. Following the folding of the lateral sheet 52 and of the peripheral sheet 53, integrally joined with said lateral sheet, said sheets are constrained to each other via gluing, said glued sheets defining the seat 49 within which the selector 90 is engaged. The semifinished product from which the selector is obtained can be distinct and completely separate from the first and second blanks.

Figure 11:
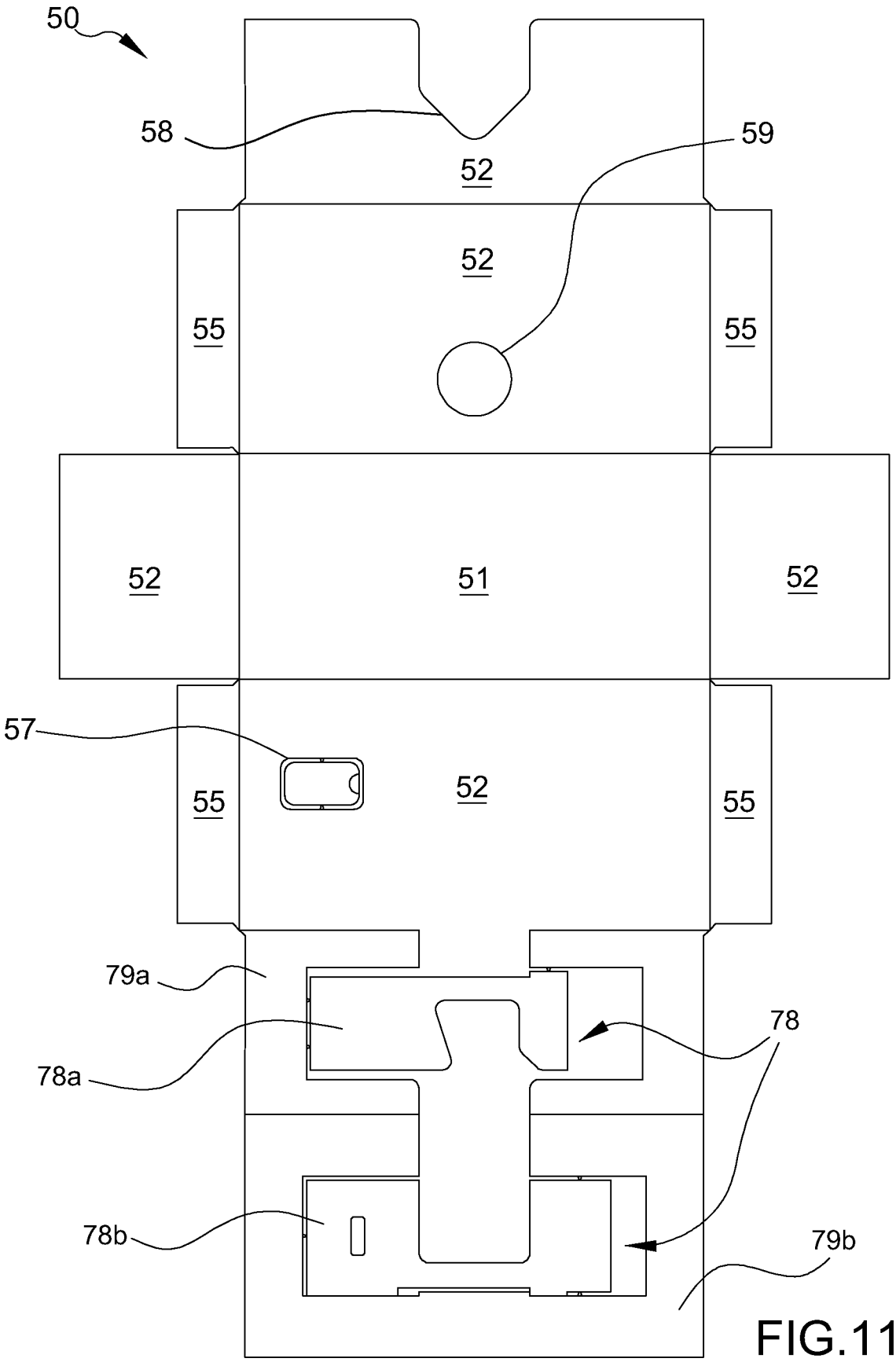
FIGS. 11 and 12 are further views of blanks for making a case and a container of a package in accordance with the present invention.
Figure 12:
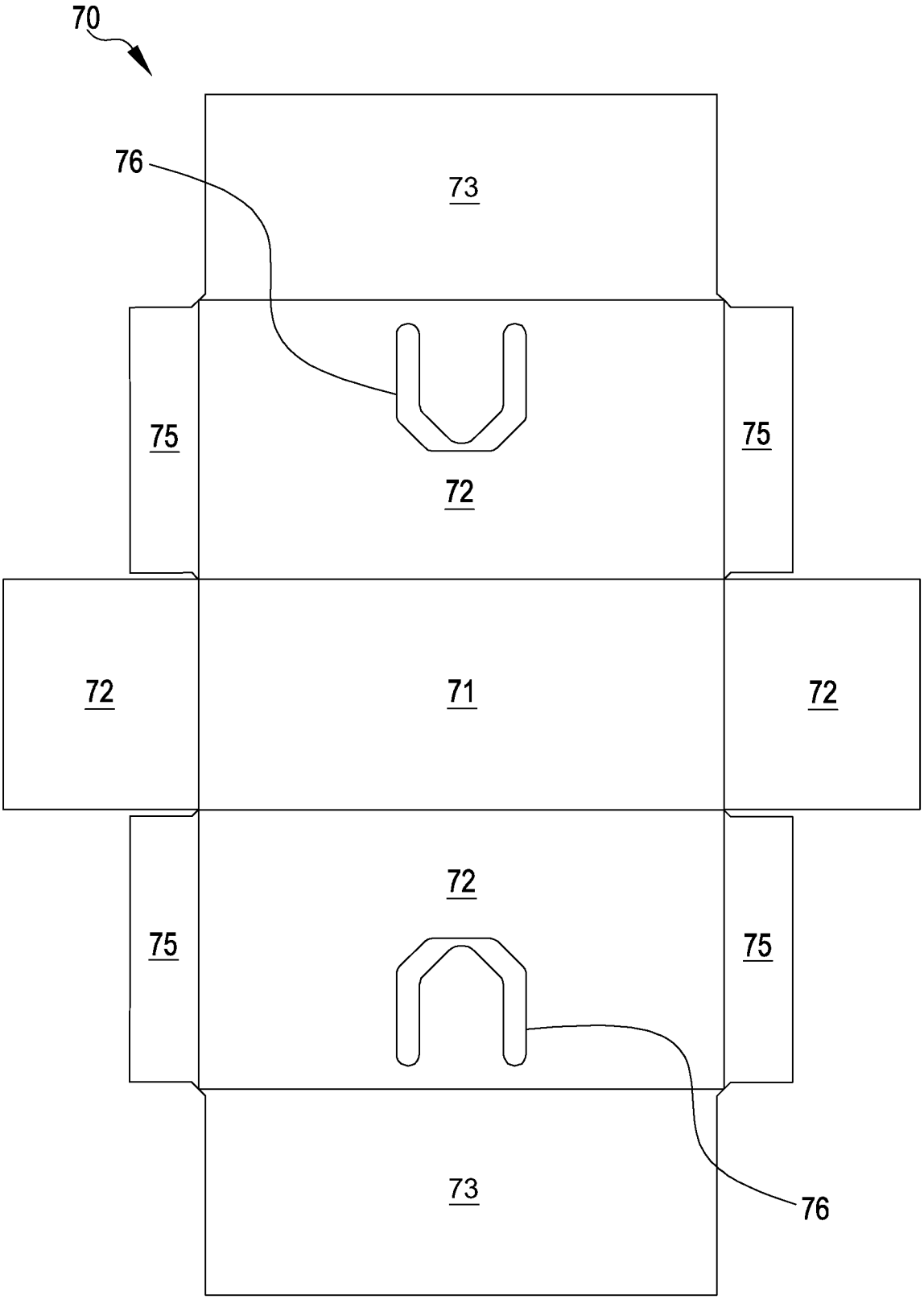

Alternatively, the first blank 50 can comprise a first and a second auxiliary sheet 79*a*, 79*b* integrally joined with each other and emerging from a lateral sheet 52 on the side opposite the central sheet 51: the first auxiliary sheet 79*a* is interposed between the second auxiliary sheet 79*b* and the lateral sheet 52 of the first blank (FIG. 11). The selector 90 can be obtained by means of a step of notching the first and/or second auxiliary sheet 79*a*, 79*b*; following the notching of the first and/or second auxiliary sheet, said second sheet 79*b* is folded on the first auxiliary sheet 79*a* in a manner such that the first and the second auxiliary sheet are superimposed on each other. At this point the process provides for a further step of folding said auxiliary sheets superimposed on the lateral sheet 52 (directly integrally joined with said first auxiliary sheet) in a manner such that the said lateral sheet 52 can define an external lateral wall 104 of the case 102 while the first auxiliary sheet 79*a* defines the internal panel 10*b* of the same case: the second auxiliary sheet 79*b* will be interposed between the lateral wall of the case 104 and the internal panel 10*b*. In the enclosed figures, the flat sheet was represented with reference number 78, such sheet adapted to define the selector. In FIG. 1, the sheet 78 is distinct and separate from the blanks 50 and 70 while in FIG. 11 the sheet 78 is obtained by means of cutting the first and/or second auxiliary sheet 79*a*, 79*b*: such cutting step defines a first and a second further sheet 78*a*, 78*b* which are configured for defining the first coupling portion (12). In detail, the first and a second further sheet 78*a*, 78*b* following the cutting step are joined together in order to define the selector 90 on which the first coupling portion 12 is in turn defined.

The process provides for arranging the container 1 attainable by means of a second flat blank 70 made of sheet material, optionally paper. The first blank 70 comprises:

a central sheet 71, a predetermined number of lateral sheets 72 integrally joined with the central sheet 71 and emerging from the latter starting from a perimeter edge.

The central sheet 71 has a polygonal shape, optionally rectangular or square. From each side of the central sheet 71, a lateral sheet 72 is extended, also having a polygonal shape, optionally rectangular or square. The arranging container 1 comprises the sub-step of folding the predetermined number of lateral sheets 72 in order to define the predetermined number of lateral walls 4 of the container 1. In detail, the lateral sheets 72 are folded with respect to the central sheet 71 in a manner such that from the flat blank 70 it is possible to obtain a container 1 having three-dimensional conformation. The lateral sheets 72 are constrained with each other in a manner such that the container 1 can maintain its three-dimensional form; the lateral sheets 72 can be constrained directly to each other by means of glue or any one adhesive material. Alternatively, the blank 70 can be provided with at least one connection sheet 75 which integrally joins two adjacent lateral sheets 72 (FIG. 1); in such configuration, the process—simultaneously with the folding of the lateral sheets 72—provides for the superimposition and joining, e.g. by means of gluing, of the connection sheet 75 to folded adjacent lateral sheets 72: in this manner, the container 1 can maintain its three-dimensional form with the lateral sheets 72 which define the lateral walls 4 and the central sheet 71 to define the bottom wall 9.

The process also provides for the definition of the at least one second coupling portion 13. Each second coupling portion 13 can be executed by means of the arranging of a peripheral sheet 73 integrally joined with at least one of said lateral sheets 72 and emerging from a perimeter edge of at least one lateral sheet 72 of the second blank 70 itself on the side opposite the central sheet 71 of the second blank. Then, the peripheral sheet 73 is folded above the lateral sheet 72 of the same second blank 70 with which said peripheral sheet 73 is integrally joined; following the folding, the peripheral sheet 73 is at least partly superimposed and facing the lateral sheet 72 with which it is directly integrally joined. Following the folding of the peripheral sheet 73, at least one part of this is constrained, e.g. by means of gluing, to a part of the lateral sheet 72 with which it is directly integrally joined (directly to the lateral wall 4). The folding of the at least one peripheral sheet 73 can be executed before, simultaneously or after the folding and constraining of the lateral sheets 72. In one embodiment, the peripheral sheets 73 are folded before the folding of the lateral sheets 72; only following the folding of the peripheral sheets 73, the process provides for the folding and constraining of the lateral sheets 72 in a manner such that simultaneously with the definition of the lateral walls 4, one obtains the definition of the second coupling portion 13.

Figure 2:
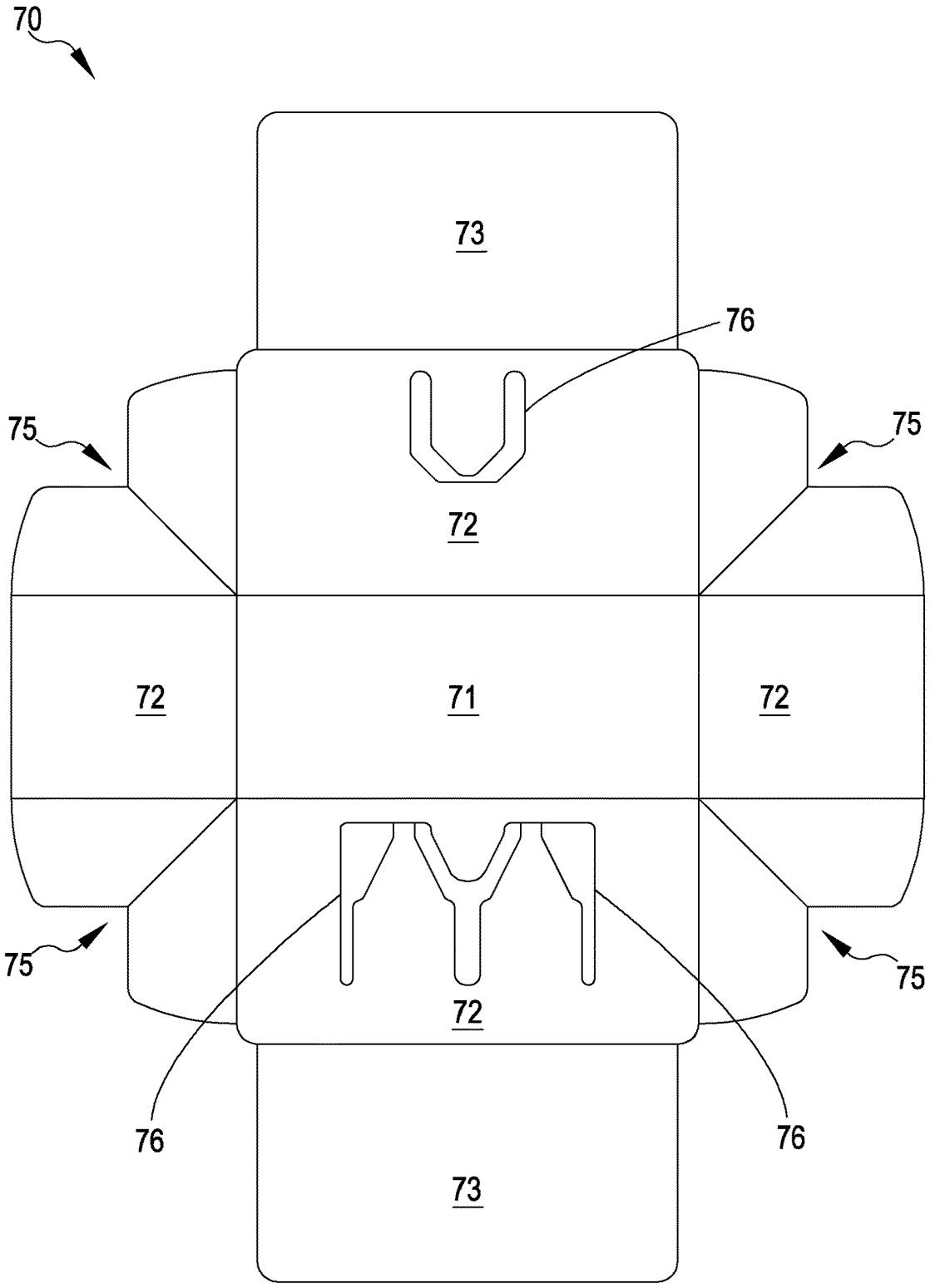
Figure 14:
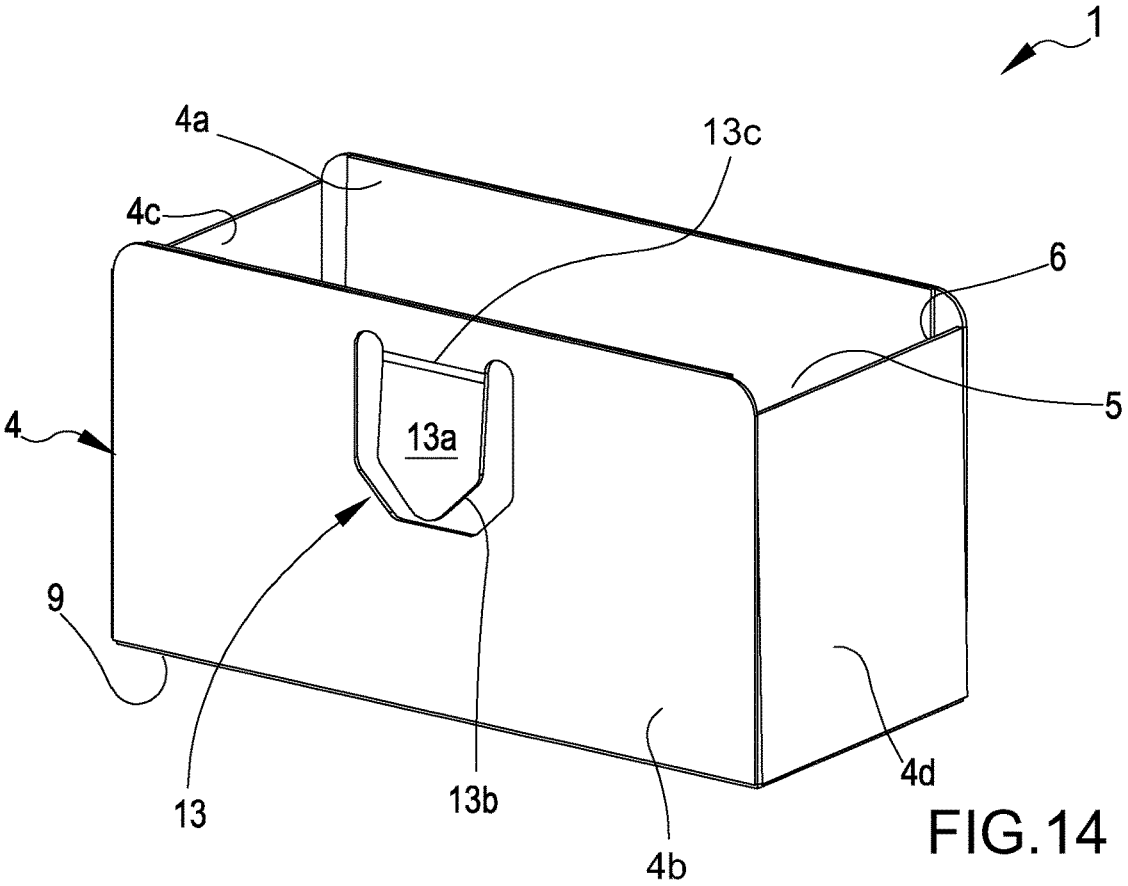
FIG. 14 is a further perspective view of a container of a package in accordance with the present invention.
Figure 15:
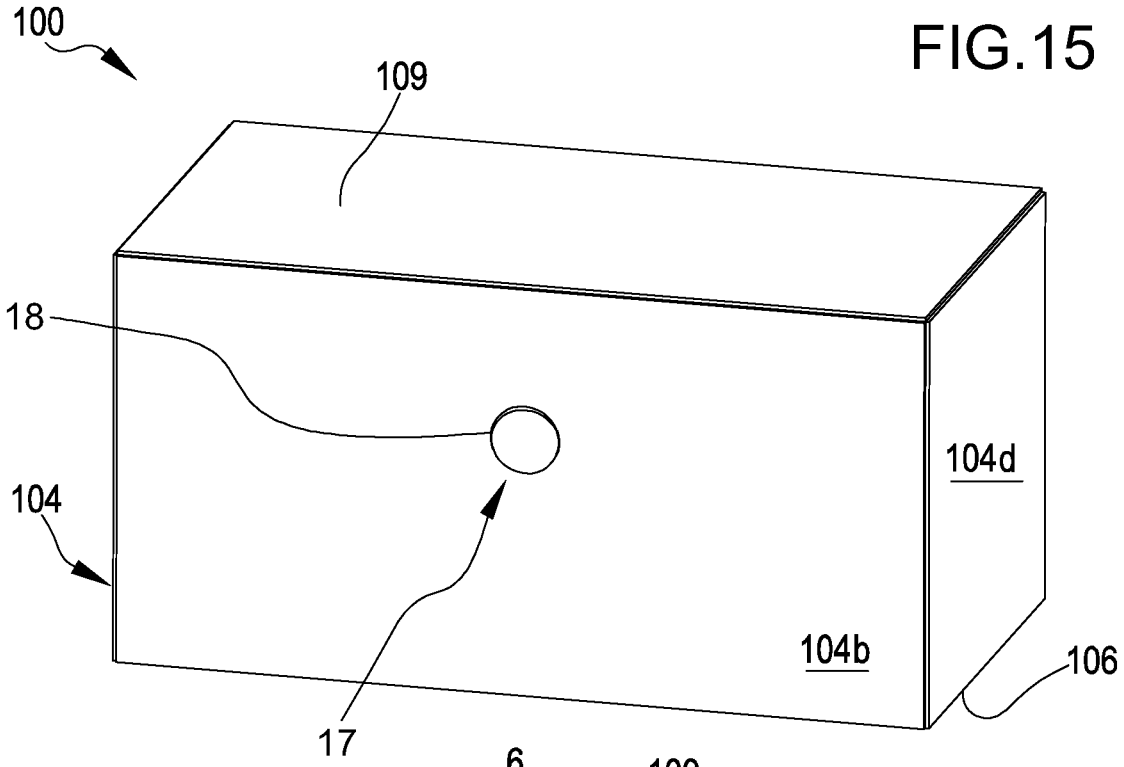
FIG. 15 is a perspective view of a package in accordance with the present invention arranged in a closed condition.
Figure 16:
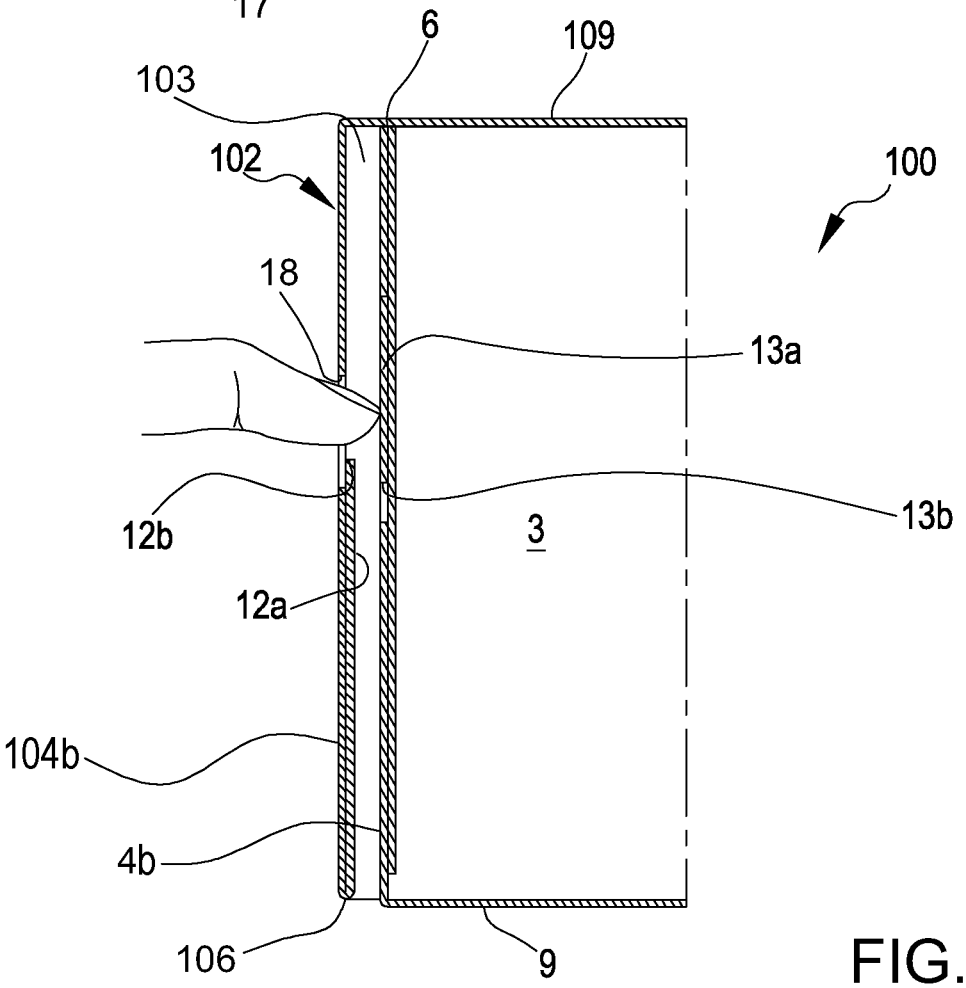
FIG. 16 is schematic section view of an open condition of a package in accordance with the present invention.

Alternatively, the second coupling portion 13 can be obtained by means of a step of cutting one of said lateral sheets 72 of the second blank 70 in order to define, directly on said lateral sheet, at least one through notch 76 (FIGS. 2 and 14) adapted to define the panel 13*a* of the second coupling portion 13 in accordance with that illustrated for example in FIG. 14.

The central sheet 71, the lateral sheets 72 and the possible peripheral sheet 73 (if present) of the second blank 70 can be integrally joined to define a single blank made of a single piece, e.g. at least partly of paper material. The container 1 is then obtainable by means of steps of folding and gluing a single sheet blank (first flat blank 70).

The central sheet 71, the lateral sheets 72 and the possible peripheral sheet 73 (if present) of the second blank 70 can be integrally joined to define a single blank made of a single piece, e.g. at least partly made of paper material. The container 1 is then obtainable by means of steps of folding and gluing a single sheet blank (first flat blank 70). The second blank 70 can be obtained by means of one or more steps of die cutting a single precursor sheet. The first and second blank 50, 70—even if obtainable by means of a step of die cutting a single sheet—are distinct and separate pieces, separately workable in order to obtain a case 102 separated from the container 1.

Closing Method

Also forming the object of the present invention is a method for closing a package 100 in accordance with one or more of the enclosed claims and/or in accordance with the above-reported description.

The method comprises a step of positioning the case 102 outside the container 1 in a manner such that the latter can be at least partly housed in the internal volume of the case 102. Before the step of positioning the case 102 outside the container 1—said case and container can be completely separate and distinct from each other. Then, case 102 and container 1 are relatively moved with respect to each other in a manner such to define the closed condition. The relative movement of case and container in the closed condition allows carrying the first coupling portion 12 at the second coupling portion 13 where the two portions can be engaged with each other. The relative movement provides for the relative translation of the case 102 outside the container 1 with the lateral walls 104 of the case 102 strictly facing the lateral walls 4 of the container 1. The relative movement provides for the relative translation of the case 102 with respect to the container 1 up to an end stop position in which the top wall 109 of the case 102 is abutted against the free edge 6 of the container 1 (FIG. 6); in the end stop position, the free edge 106 of the case 102 is arranged at the bottom wall 9 of the container 1. In the end stop position the free edge 6 of the container is abutted against the top wall 109 of the case 102 and prevents a further relative approaching between the bottom wall 9 of the container 1 and the top wall of the case 102.

The method also provides for arranging at least one between the first and the second movable coupling portion 12, 13 in the first operative position (FIG. 5) so as to allow the engagement thereof and the consequent definition of the locking condition. In the end stop position and in the first operative position of the coupling portion (12 and/or 13), the first coupling portion 12 is situated facing the second coupling portion 13 of the container 1 and ready to receive the latter in engagement.

In fact, once such coupling portions (12, 13) are situated at each other (e.g. in the end stop position) and in the first operative position of the movable coupling portion, the engagement is obtained of the first and of the second coupling portion 12, 13 of the safety device 11 to define the locking condition. With relative movement of the case with respect to the container it is intended the movement of both parts, i.e. case and container, or the movement of only one of said parts (only the case 102 or only the container), maintaining stopped the other of the two parts (maintaining fixed the case 102 or the container) in a manner such that a relative motion is defined between these (case and container).

Opening Method

Also forming the object of the present invention is a method for opening a package 100 in accordance with one or more of the enclosed claims and/or in accordance with the above-reported description. Before the execution of the method for opening the package 100, the latter is situated in the locking condition of the safety device.

The opening method comprises the movement (translation within the seat 49) by the first and/or second movable coupling portion 12, 13 into the second operative position in a manner such to allow the disengagement between the first and the second coupling portion 12, 13. The step for moving the movable coupling portion (in the case illustrated in the enclosed figures, it is represented by the first coupling portion) occurs from outside the package 100 through the through opening 48. In detail, such step provides for the movement of the selector 90, on which the first coupling portion 12 is defined, into the second operative position in a manner such to move the first coupling portion into the respective second operative position. Due to the movement of the selector 90 the latter is capable of pushing the second coupling portion 13 away from the first coupling portion 12 and in particular close to the compartment 3. Following the step of disengaging the first and the second coupling portion 12, 13 the process provides for the relative moving away movement of the container 1 and of the case 102 up to reaching the open condition.

If the package also comprises a release portion 17, the opening method comprises the following steps:

- contacting, in the locking condition and from outside the package 100, at least one between the first and the second coupling portion 12, 13 through the release portion 17,
- disengaging the first and the second coupling portion 12, 13,
- following the step of disengaging the first and the second coupling portion 12, 13, relatively moving away the container 1 and the case 102 up to reaching the open condition of the package.

The step of contacting at least one between the first and the second coupling portion 12, 13 can comprise at least one from among the following sub-steps:

- inserting at least one opening device through the through access 18 of the release portion 17,
- manually contacting at least one between the first and the second coupling portion 12, 13, e.g. by means of insertion of a finger of a user through the through access 18 of the release portion 17, deforming a thrust portion of the same case 102 in a manner such that such thrust portion can contact at least one between the first and the second coupling portion 12, 13.

The disengagement step comprises the thrust of the panel 13*a* of the second portion of the container 1 away from the tab 12*a* of the first coupling portion, i.e. close to the compartment 3.

If the package comprises two first coupling portions 12 defined on opposite walls of the case and two respective second coupling portions 13 defined at opposite lateral walls of the container, as well as a selector 90, for one pair of said first and second coupling portions, and a release portion 17, for the other between said first and second coupling portions, the opening method provides for both the movement of the selector 90 from the first to the second operative position and also the intervention, through the release portion 17, on said first and the second coupling portion 12, 13 placed in proximity to said release portion 17. Only following the disengagement of all the first coupling portions from the respective second coupling portions, the method can provide for a step of moving away movement of the container 1 and the case 102 up to reaching the open condition of the package.

The invention claimed is:

1. A child-proof package comprising:

a container defining a compartment for housing a product, said container having a predetermined number of first lateral walls defining an opening delimited by a first free edge, said opening configured to allow insertion and removal of the product from the container;

a case having a predetermined number of second lateral walls defining an access delimited by a second free edge configured to allow passage of the container, said predetermined number of second lateral walls of the case delimiting an internal volume configured to receive at least part of the container, wherein the container is moveable relative to the case between: (i) a closed condition in which the case obstructs the opening of the container, wherein the container, in said closed condition, is arranged at least partly in the internal volume, and (ii) an open condition in which the case allows communication between the compartment and the external environment, and a safety device comprising:

a first coupling portion directly carried by one of the second lateral walls of the case and at least partly arranged in the internal volume, a second coupling portion carried by the container and arranged outside the compartment, wherein at least one of the first coupling portion and the second coupling portion, while the container is in the closed condition, is movable relative to the other of the second coupling portion and the first coupling portions between: (i) a first operative position in which the first coupling portion and the second coupling portion are configured to stably engaged with each other to define a locking condition of the safety device, and (ii) a second operative position in which the first coupling portion and the second coupling portion cannot be engaged with each other and the container is able to move from the closed condition to the open condition, and wherein the first coupling portion is movable relative to the case between the first operative position and the second operative position along a trajectory which lies on a plane parallel to a lying plane of the one of the second lateral walls carrying said first coupling portion.

2. The child proof package according to claim 1, wherein the one of the second lateral walls of the case directly carrying the first coupling portion has a through opening configured to allow, in the closed condition of the case and the container and from outside the package, contacting at least one of the first coupling portion and the second coupling portion to allow movement between the first operative position and the second operative position.

3. The child proof package according to claim 2, wherein the at least one of the first coupling portion and the second coupling portion is movable relative to the other between said first operative position and the second operative position, and comprises at least one handling portion facing the through opening of the case and configured to allow movement of said the first coupling portion and/or the second coupling portion between the first to the second operative position, and, the through opening is configured to allow a user, at least during the closed condition of the container and the case, to contact, from outside the package, the handling portion and to move the first coupling portion and/or the second coupling portion between the first operation position and the second operative position.

4. The child proof package according to claim 3, wherein the first coupling portion is a tab arranged in the internal volume, wherein the tab defines an undercut delimited by at least one gripping edge placed entirely in the internal volume, distinct and distanced from the free edge of the access, and wherein the gripping edge of the tab of the first coupling portion is at least for one section tilted with respect to the free edge of the access by an angle in a range of 20° to 80°.

5. The child proof package according to claim 4, wherein the gripping edge of the tab of the first coupling portion has a "V" or "C" shape with a concavity directed on an opposite side with respect to the free edge of the access of the case.

6. The child proof package according to claim 4, wherein the second coupling portion comprises at least one panel engaged with at least one lateral wall of the container and emerging from said lateral wall according to a direction exiting from the compartment, wherein the panel of the second coupling portion defines an undercut delimited by at least one gripping edge placed outside the compartment, distinct and distanced from the free edge of the opening of the container itself, wherein the undercut defined by the panel of the second coupling portion, in the closed condition and when the first and/or second coupling portion is in the first operative position, is stably engaged with undercut of the tab of the first coupling portion to define said locking condition.

7. The child proof package according to claim 6, wherein the gripping edge of the panel of the second coupling portion has a "V" or "C" shape whose concavity is substantially directed towards the free edge of the opening of the container.

8. The child proof package according to preceding claim 1, wherein the case comprises at least one external panel and one internal panel defining a seat within which the first coupling portion is housed, movable between the first operative position and the second operative position, and wherein the external panel defines at least part of a lateral wall of the case, the internal panel being arranged, at least in the closed condition, in interposition between the external panel and the container.

9. The child proof package according to claim 8, wherein the external panel and the internal panel are integrally joined at a folding edge and face each other to define a folded portion, the folding edge of the external panel and internal panel defining at least part of said free edge of the case, wherein the first coupling portion is movable via translation relative to the case along a direction substantially parallel to said folding edge.

10. The child proof package according to claim 8, wherein the internal panel has a through pocket configured allow the second coupling portion, emerging from the first lateral walls of the container, to engage the first coupling portion while the in the first operative position.

11. The child proof package according to claim 1, wherein the second coupling portion is movable close to and away from the compartment of the container along a predetermined trajectory, wherein the first coupling portion, in the closed condition, is movable at least along a direction transverse to the trajectory along which said second coupling portion is movable.

12. The child proof package according to claim 1, wherein the first coupling portion, during the movement from the first operative position to the second operative position, is configured to move the second coupling portion close to the compartment of the container to allow disengagement between the first coupling portion and the second coupling portion.

13. The child proof package according to claim 1, further comprising a selector carried by the case, wherein the selector is movable relative to the case.

14. The child proof package according to claim 13, wherein the case comprises at least one external panel and one internal panel defining a seat, wherein the selector is housed and slidably movable within the seat, wherein the selector extends substantially parallel to at least one of the external panel and the internal panel delimiting said seat, and wherein the selector is movable along a plane substantially parallel to a lying plane of at least one between the internal panel and the external panel of the case defining the seat.

15. A child-proof package comprising:

a container defining a compartment for housing at least one product, said container having a predetermined number of lateral walls defining an opening delimited by a free edge, said opening configured to allow insertion and picking up of the product from the container, a case having a predetermined number of lateral walls defining at least one access delimited by a free edge configured for allowing the passage of the container, said predetermined number of lateral walls of the case delimiting an internal volume configured to receive at least part of the container, wherein the container moves relative to the case between: (i) a closed condition in which the case obstructs the opening of the container and the container is at least partly in the internal volume, and (ii) an open condition in which the case allows communication between the compartment and the external environment, and a safety device comprising:

a first coupling portion carried by the case and at least partly arranged in the internal volume, a second coupling portion carried by the container and arranged outside the compartment, wherein at least one of the first coupling portion and the second coupling portion, at least while in the closed condition, is movable relative to the other of the second coupling portion and the first coupling portion and between: (i) a first operative position in which the first coupling portion and the second coupling portion are configured to stably engaged each other to define a locked condition of the safety device, and (ii) a second operative position in which the first coupling portion and the second coupling portion cannot be engaged with each other and the case is able to move with respect to the container from the closed condition to the open condition, wherein the case comprises at least one external panel and one internal panel forming a seat between the at least one external panel and the at least one internal panel, wherein the external panel defines at least part of one of the lateral walls of the case, and the internal panel is arranged, at least in the closed condition, in interposition between the external panel and the container, and wherein the first coupling portion is housed within the seat and movable relative to the seat between the first and the second operative position along a trajectory in a plane parallel to a plane of the seat.

16. The child proof package according to claim 15, wherein the external panel and the internal panel are integrally joined at a folding edge and facing each other to define a folded portion, the folding edge of the external panel and internal panel defining at least part of said free edge of the case, and wherein the first coupling portion is movable via translation relative to the case along a direction substantially parallel to said folding edge.

17. The child proof package according to claim 15, wherein the internal panel has a through pocket configured to allow the second coupling portion to emerge from a lateral wall of the container, to engage the first coupling portion, in the closed condition and in the first operative position of the first coupling portion.

18. The child proof package according to claim 15, further comprising a selector carried by the case on which at least one of: the first coupling portion is defined, and the selector, at least in the closed condition of the package, is movable relative to the case inside the seat.

19. A child-proof package comprising:

a container including first lateral walls each having side edges each connected to one of the side edges of an adjacent one of the first lateral walls, and a bottom wall having side edges connected to a bottom edge of each of the first lateral walls, wherein the first lateral walls and the bottom wall define a compartment configured to house a product, and each of the first lateral walls has a free top edge opposite to the bottom wall, wherein the free top edges define a first opening to the compartment and first opening is configured to receive the product;

a case including second lateral walls each having side edges each connected to one of the side edges of an adjacent one of the second lateral walls, and a top wall having edges connected to a top edge of each of the second lateral walls, wherein the second lateral walls each have a free edge defining a second opening configured to receive container, wherein the top wall forms a top of the compartment, and a safety device comprising:

a first coupling portion within the one of the second lateral walls of the case, a second coupling portion integral with the container and arranged outside the compartment, wherein at least one of the first coupling portion and the second coupling portion is movable relative to the other of the second coupling portion and the first coupling portions and between: (i) a first operative position in which the first coupling portion and the second coupling portion are configured to stably engaged each other to define a locking condition of the safety device in which the container is locked to the case, and (ii) a second operative position in which the first coupling portion and the second coupling portion are disengaged and the container is free to slide away from the case, and wherein the first coupling portion is movable relative to the one of the second lateral walls carrying the first coupling portion along a plane parallel to a lying plane of the one of the second lateral walls carrying said first coupling portion between the first operative position and the second operative position.

* * * * *